US011950693B2

(12) United States Patent
Le

(10) Patent No.: US 11,950,693 B2
(45) Date of Patent: Apr. 9, 2024

(54) ADJUSTABLE SHELVING RACK AND METHOD FOR USING THE SAME

(71) Applicant: Cambro Manufacturing Company, Huntington Beach, CA (US)

(72) Inventor: Johannes Le, Huntington Beach, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 0 days.

(21) Appl. No.: 18/312,381

(22) Filed: May 4, 2023

(65) Prior Publication Data

US 2023/0270250 A1 Aug. 31, 2023

Related U.S. Application Data

(62) Division of application No. 17/004,466, filed on Aug. 27, 2020, now Pat. No. 11,690,450.

(51) Int. Cl.

| | |
|---|---|
| ***A47B 88/407*** | (2017.01) |
| ***A47B 57/58*** | (2006.01) |
| ***A47B 88/417*** | (2017.01) |

(52) U.S. Cl.

CPC ..... *A47B 88/407* (2017.01); *A47B 57/58* (2013.01); *A47B 88/417* (2017.01)

(58) Field of Classification Search

CPC ..... A47B 88/407; A47B 88/417; A47B 57/58; A47B 57/583; A47B 57/586

See application file for complete search history.

(56) References Cited

U.S. PATENT DOCUMENTS

| | | | | |
|---|---|---|---|---|
| 1,375,855 A * | 4/1921 | John | A47B 57/58 248/243 |
| 1,748,339 A | 2/1930 | Gerberich | |
| 1,863,625 A * | 6/1932 | Fenstermaker | A47B 57/58 211/184 |
| 3,515,450 A * | 6/1970 | Jaecke | A47B 47/0075 312/209 |
| 3,653,735 A * | 4/1972 | Duepree | A47B 88/417 312/330.1 |

(Continued)

FOREIGN PATENT DOCUMENTS

| | | |
|---|---|---|
| CH | 262759 A * | 7/1949 |
| DE | 3101132 A1 * | 7/1982 |

(Continued)

*Primary Examiner* — Stanton L Krycinski
(74) *Attorney, Agent, or Firm* — Marcus C. Dawes

(57) ABSTRACT

An adjustable shelving rack and system for storing and maintaining a plurality of item containers within a shelving unit in a stacked, vertical configuration. Each of the plurality of adjustable shelving racks are selectively coupled to a horizontal traverse of the shelving unit at a user determined position. The item containers may then be inserted by disposing each item container on one of a plurality of supports within each shelving rack. By having two shelving racks in close proximity to one another, each item container may be held in a suspended configuration with either side of the item container supported by a different shelving rack. Each shelving rack is coupled to a plurality of traverses through a corresponding plurality of vice assemblies which are selectively actuated to grip or apply a squeezing force to each traverse.

9 Claims, 15 Drawing Sheets

(56) References Cited

U.S. PATENT DOCUMENTS 3,807,572 A * 4/1974 Luvara ..... A47B 57/58 211/187
3,868,123 A * 2/1975 Berg ..... B62B 3/006 312/249.11
3,872,802 A * 3/1975 Scheerhorn ..... A47B 57/58 211/184
3,971,608 A * 7/1976 Gans ..... A47B 88/407 312/257.1
4,043,625 A * 8/1977 Bleeker ..... A47B 57/58 312/351
4,193,650 A * 3/1980 Gray ..... A47B 57/58 108/92
4,502,741 A * 3/1985 DeVries ..... A47F 3/063 312/334.44
4,728,158 A * 3/1988 D'Elia ..... A47B 57/06 220/532
5,016,948 A * 5/1991 Welch ..... B65H 35/002 D34/21
5,094,516 A 3/1992 Hunter
5,353,714 A * 10/1994 Hardy ..... A47B 57/58 211/184
5,372,415 A * 12/1994 Tisbo ..... A47B 61/00 403/231
5,466,058 A * 11/1995 Chan ..... A47B 95/02 312/109
5,549,374 A * 8/1996 Krivec ..... A47B 88/417 384/42
5,975,660 A * 11/1999 Tisbo ..... A47B 47/045 312/265.2
6,409,037 B1 * 6/2002 Lin ..... E05D 7/1011 220/23.8
6,557,709 B2 * 5/2003 Broome ..... H05K 7/186 211/183
6,824,232 B2 * 11/2004 Farmer ..... A47B 88/402 312/348.3
7,721,659 B2 * 5/2010 Fast ..... A47B 57/58 24/563
8,388,073 B2 * 3/2013 Richter ..... A47B 47/025 312/263
9,661,920 B2 * 5/2017 Ahart ..... A47B 57/08
9,682,011 B2 * 6/2017 Zhang ..... A47B 88/407
10,029,718 B2 * 7/2018 Benning ..... B62B 3/005
10,046,719 B2 8/2018 Workman
10,215,474 B2 * 2/2019 Lim ..... F25D 25/025
10,271,648 B2 * 4/2019 Harder ..... A47B 88/43
10,772,424 B2 * 9/2020 Turner ..... A47B 57/58
10,881,199 B1 * 1/2021 Le ..... A47B 88/417
2002/0063100 A1 * 5/2002 Kwang ..... G11B 33/0483 211/41.12
2006/0175945 A1 * 8/2006 Deguchi ..... A47B 47/0075 312/257.1
2021/0022499 A1 * 1/2021 Larkner ..... A47B 88/477
2021/0401167 A1 * 12/2021 Nance ..... A47B 87/0276

FOREIGN PATENT DOCUMENTS

DE 29502912 U1 * 5/1995
DE 29506782 U1 * 8/1995
EP 0993793 A1 * 4/2000
EP 2159523 A1 * 3/2010 ..... A47B 88/40
EP 2666396 A2 * 11/2013 ..... A47B 88/0407
FR 1200912 A * 12/1959
FR 1255067 A * 3/1961
FR 1368773 A * 8/1964
FR 1542769 A * 10/1968
FR 2838938 A1 * 10/2003 ..... A47B 88/0407
GB 480014 A * 2/1938
GB 826073 A * 12/1959
GB 2347843 A * 9/2000 ..... A47B 57/10
KR 20090082055 A * 7/2009

* cited by examiner

FIG. 5A
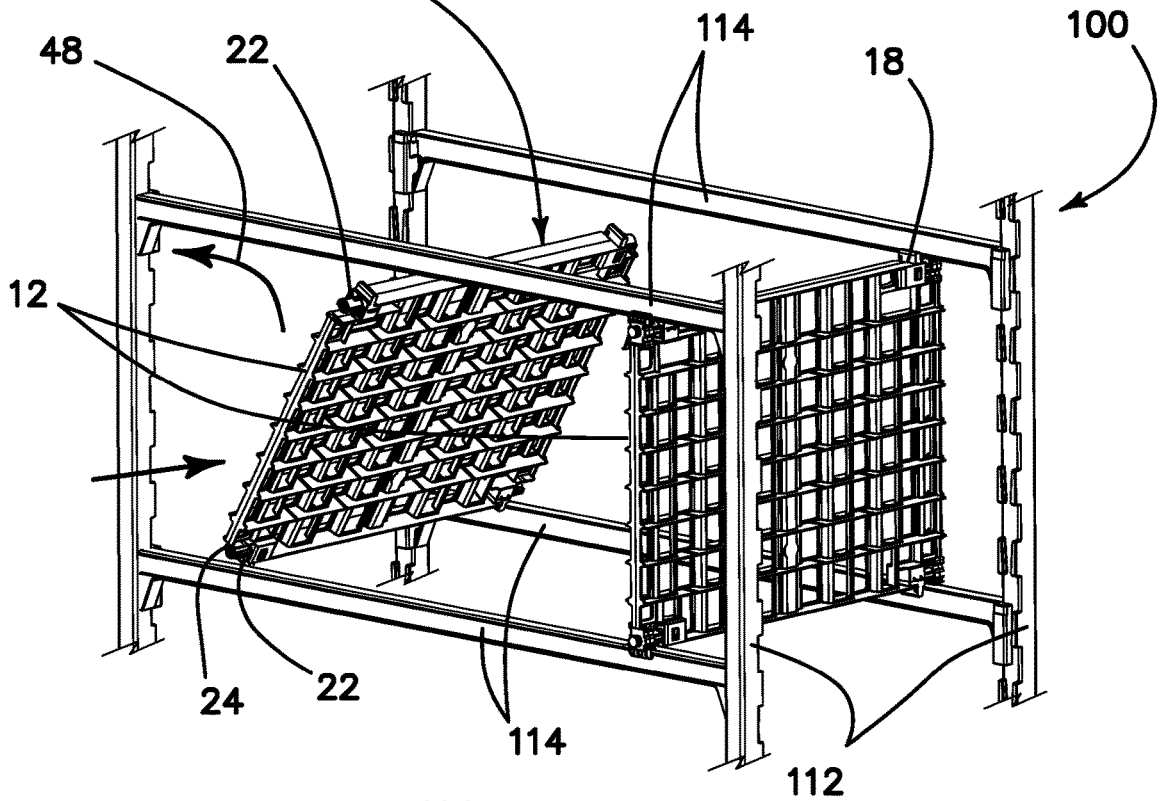
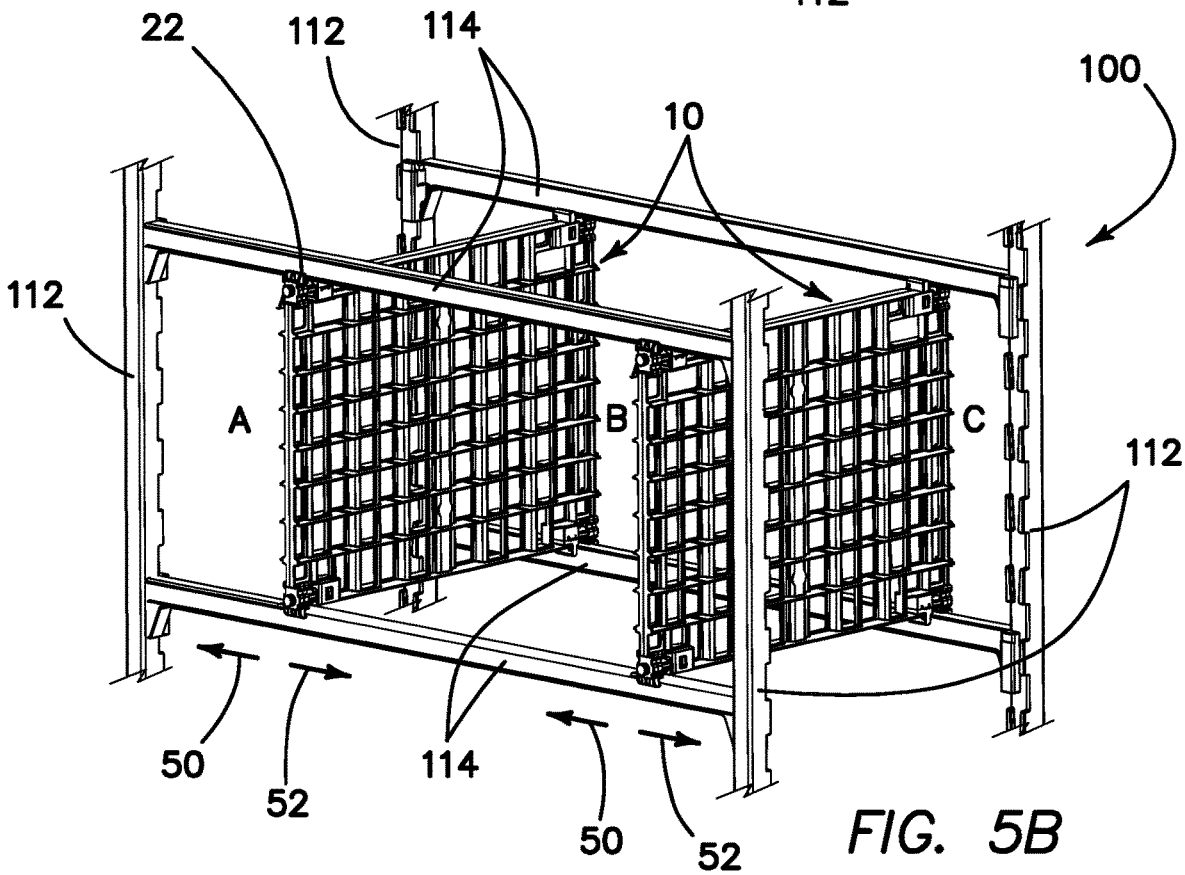
FIG. 5B

ADJUSTABLE SHELVING RACK AND METHOD FOR USING THE SAME

BACKGROUND

This application claims priority to, and the benefit of the earlier filing date of U.S. non-provisional application Ser. No. 17/004,466, filed on Aug. 27, 2020, pursuant to 35 USC 120, the contents of all of which are incorporated herein by reference.

FIELD OF THE TECHNOLOGY

The invention relates to the field of adjustable shelving accessories, in particular adjustable and mobile shelving racks providing a user with the ability to create a customized organized shelving unit or system.

DESCRIPTION OF THE PRIOR ART

As is well known in the art, shelves, cabinets, racks, and an untold number of other furniture pieces or structures have been used to accommodate and/or store goods and items of nearly any variety or type. Many of these units not only contain a number selves which are arranged in a vertical configuration, but also wherein each shelf includes a partition or other structural component which physically sub-divides or breaks the shelf into multiple compartments.

For example, U.S. Pat. No. 6,164,215 discloses a cabinet assembly comprising a number of shelves, each shelf itself comprising a number of shelf dividers. Each divider comprises one or more tabs which are slotted into the shelves in order to split up the storage space of each shelf.

Another example of a shelf divider can be found in U.S. Application Publication 2011/0139736 which discloses a rack which is used to display a plurality of items while also sub-dividing a shelf. Specifically, each divider includes a track and a movable pusher which pushes an item from a rear portion of the divider to the front when a previous item is removed from the display.

Yet another prior art solution for sub-dividing a shelf can be found in U.S. Pat. No. 6,116,436 which discloses a plurality of wire frame storage dividers for reels. After each storage divider is located on its corresponding shelf, a reel is dropped in or inserted therein so that the reel remains in the vertical position, thereby allowing the user store a large number of reels on a single shelf.

However while each prior art solution including those listed above allow a user to sub-divide a shelf by inserting or attaching any number of dividers or partitions thereon, each shelf divider fails to hold or accommodate items or goods directly in a suspended and stacked configuration. Instead, each divider may allow a user to lean or prop up an item against the divider, but in each instance the item is still principally in contact with a surface of the shelf, thereby requiring a horizontally disposed shelf surface or shelf plate. This can create a problem in some instances however where a large cabinet or shelving system may contain multiple shelves which in turn dramatically increases the overall weight of the shelving, thereby making the shelving system more difficult to move or adjust. In addition to increasing the overall weight of the cabinet or shelving system, shelf plates or other material used to form each shelf surface can also make the cabinet or shelving system more expensive to manufacture which is typically passed on the consumer. Furthermore, because the prior art dividers fail to hold or accommodate the items being stored directly, this can lead to some of the items shifting or moving within each shelf, thus increasing the possibility that items can become damaged.

What is needed therefore is an apparatus and method for sub-dividing and organizing a shelf unit which does not dramatically increase the overall weight of the shelving unit while also providing additional structural support to any items being stored by directly accommodating the items themselves. The apparatus should be easy and quick to use and not require any additional tools or parts beyond the frame of the shelving unit itself.

BRIEF SUMMARY

As is well understood, it can be very difficult to easily access items from a stack of items that are disposed on a shelf. If the item at the bottom of the stack is needed, then the whole stack needs to be removed from the shelf. This is not only inefficient, but it also means that items being stored must be placed on possibly unsafe or undesired surfaces.

The modular design of the adjustable shelving racks of the current invention solves this problem by permitting a user to add shelving racks to a shelf ad infinitum and completely customize a shelf or shelving unit to hold different sizes of items between each set of shelving racks in a highly efficient and convenient manner. Each adjustable shelving rack maximizes vertical food storage and offers "slide in and out" access to each item from top to bottom within each formed "stack." The adjustable shelving racks allow for side loading and end loading and can each be adjusted along the length of a single shelf to hold many different storage devices or containers such as but not limited to food pans, market trays, and food boxes.

The current invention provides an apparatus for maintaining a plurality of containers in a suspended stacked configuration within a shelf of a shelving unit. The apparatus includes a panel comprising a plurality of horizontal supports and a plurality of removeable vice assemblies coupled to the panel. Each of the plurality of horizontal supports extend perpendicularly outward from a vertical plane that is defined by the panel while each of the plurality of removable vice assemblies is configured to selectively grip or squeeze at least one traverse forming the shelf.

In one embodiment, each of the plurality of removeable vice assemblies includes a fixed clamp, a moveable clamp, and means for selectively adjusting the position of the moveable clamp relative to the fixed clamp. Specifically, the panel comprises a plurality of recesses which are each configured to accommodate the fixed clamp therein. Even more specifically, the fixed clamp of each of the plurality of vice assemblies includes a dual-prong clip while each of the plurality of recesses has a window defined therein to accommodate the dual-prong clip.

In a related embodiment, the means for selectively adjusting the position of the moveable clamp relative to the fixed clamp include a coupling portion disposed on the fixed clamp, an aperture defined through the moveable clamp, and a thumb screw disposed through the aperture and inserted into the coupling portion. In a further embodiment, the coupling portion includes an internal thread that is configured to engage a threaded portion of the thumb screw.

In yet another embodiment, a tab is coupled to each of the plurality of recesses. Here, the moveable clamp has a bracket which extends from a bottom surface of the moveable clamp, the bracket itself being configured to accommodate the tab.

In another embodiment, the fixed clamp of each of the plurality of vice assemblies has a first jaw disposed on a top surface of the fixed clamp while the moveable clamp of each of the plurality of vice assemblies has a second jaw disposed on a top surface of the moveable clamp.

In yet another embodiment, the panel includes a plurality of vertical non-linear supports that are disposed perpendicular relative to the plurality of horizontal supports. In a related embodiment, the plurality of horizontal supports of the panel each include a plurality of heat dispersing bumps disposed along a length of each of the plurality of horizontal supports and a pair of tray stoppers disposed on each longitudinal end of each of the plurality of horizontal supports In a separate embodiment, each of the plurality of coupling means includes a stationary wall, a moveable wall, and a bolt that is inserted through the moveable wall and the stationary wall. A cam lever is further disposed on the bolt so as to actuate the moveable wall relative to the stationary wall.

In a related embodiment, each of the plurality of coupling means instead includes an arm that is connected to a hinge that is disposed on the panel. A distal end of the arm in one particular embodiment includes a flexible hook. In a different embodiment, the distal end of the arm includes a flange perpendicularly orientated relative to the arm and a flange bolt that is inserted through the flange. A pad is connected to a distal end of the flange bolt and a wing nut disposed near a proximal end of the flange bolt.

The invention further provides a system for maintaining a plurality of containers in a suspended stacked configuration. The system includes a shelving unit comprising a plurality of traverses, a plurality of item containers, and a plurality of adjustable shelving racks that are selectively coupled to at least one of the plurality of traverses. Each of the plurality of adjustable shelving racks specifically includes a plurality of horizontal supports which extend perpendicularly from either side of a vertical plane as defined by a panel of each of the plurality of adjustable shelving racks. Additionally, each of the plurality of horizontal supports are configured to accommodate a side or edge of at least one of the plurality of item containers.

In one embodiment, each of the plurality of adjustable shelving racks includes a plurality of coupling means, each of the plurality of coupling means being located on the adjustable shelving rack in order to couple to a different one of the plurality of horizontal traverses.

Relatedly, each of the plurality of coupling means specifically include a fixed clamp, a moveable clamp, and means for adjusting the linear position of the moveable clamp relative to the fixed clamp. Specifically, a removable thumb screw may be disposed through the moveable clamp and inserted into the fixe clamp.

In another embodiment, each of the plurality of adjustable shelving racks includes a means for selectively adjusting the longitudinal position of the adjustable shelving rack relative to the at least one of the plurality of traverses it is selectively coupled to.

In yet another embodiment, the plurality of item containers include at least two item containers comprising different sizes.

In a further embodiment, the plurality of traverses are located within the shelving unit in order to form a plurality of different shelves. More specifically, at least one of the plurality of adjustable shelving racks is selectively coupled to at least two of the plurality of shelves.

In another embodiment, the plurality of adjustable shelving racks are selectively connected to the same one of the plurality of traverses.

In yet another embodiment, each of the plurality of adjustable shelving racks are comprised of injected molded plastic while the plurality of traverses are comprised of pultruded molded plastic.

The invention further provides a method for suspending a plurality of item containers in a shelving unit. The method includes placing a plurality of adjustable shelving racks within the shelving unit, selectively connecting the plurality of adjustable shelving racks to a plurality of traverses forming the shelving unit, and inserting the plurality of item containers in between at least two of the plurality of adjustable shelving racks. Next, each of the plurality of item containers are placed on a corresponding horizontal support within each of the at least two of the plurality of adjustable shelving racks.

In one embodiment, the method also includes adjusting a longitudinal position of at least one of the plurality of adjustable shelving racks relative to at least one of the plurality of traverses.

In another embodiment, the step of placing the plurality of adjustable shelving racks within the shelving unit involves simultaneously disposing a first plurality of vice assemblies located on each of the plurality of adjustable shelving racks over a corresponding first parallel pair of the plurality of traverses and then rotating the plurality of adjustable shelving racks relative to the first parallel pair of the plurality of traverses. Next, a second plurality of vice assemblies are simultaneously disposed over a corresponding second parallel pair of the plurality of traverses.

In one particular embodiment, the plurality of adjustable shelving racks are selectively connected to the plurality of traverses forming the shelving unit by first opening a vice assembly located on each of the plurality of adjustable shelving racks, accommodating a width of at least one of the plurality of traverses within the open vice assembly, and then closing the vice assembly. Specifically, closing the vice assembly applies a squeezing force to the at least one of the plurality of traverses by the vice assembly. Relatedly, closing the vice assembly also includes actuating a thumb screw that is disposed through the vice assembly.

In another embodiment, the step of inserting the plurality of item containers in between at least two of the plurality of adjustable shelving racks specifically includes inserting the plurality of item containers in a stacked vertical configuration between the at least two of the plurality of adjustable shelving racks.

In a further embodiment, placing each of the plurality of item containers on a corresponding horizontal support within each of the at least two of the plurality of adjustable shelving racks is accomplished by placing an edge of each of the plurality of item containers on the corresponding horizontal support and then sliding each of the plurality of item containers into the shelving unit.

In an alternative embodiment, placing the plurality of adjustable shelving racks within the shelving unit specifically includes placing the plurality of adjustable shelving racks across a plurality of shelves that are located within the shelving unit.

In yet another embodiment, placing each of the plurality of item containers on a corresponding horizontal support within each of the at least two of the plurality of adjustable shelving racks also includes placing at least two of the plurality of item containers on opposing sides of the same adjustable shelving rack.

In a related embodiment, the step of inserting the plurality of item containers in between at least two of the plurality of adjustable shelving racks specifically includes inserting a plurality of item containers of different sizes in between the at least two of the plurality of adjustable shelving racks.

In one embodiment, the step of selectively connecting the plurality of adjustable shelving racks to the plurality of traverses forming the shelving unit includes opening a cam lever assembly disposed on each of the plurality of adjustable shelving racks and accommodating a width of at least one of the plurality of traverses within the cam lever assembly. Next, the cam lever assembly is actuated to close the cam lever assembly onto the at least one of the plurality of traverses by specifically applying a squeezing force to the at least one of the plurality of traverses by the cam lever assembly.

In a separate but related embodiment, the method step of selectively connecting the plurality of adjustable shelving racks to the plurality of traverses forming the shelving unit includes accommodating a width of at least one of the plurality of traverses within a corner portion defined in each of the plurality of adjustable shelving racks and then rotating an arm connected to each of the plurality of adjustable shelving racks over the width of the at least one of the plurality of traverses. Next a distal end of the arm is connected to a lip disposed on the at least one of the plurality of traverses. Specifically, in one embodiment, the distal end of the arm is connected to the lip by fitting a hook that is disposed on the distal end of the arm around the lip. In an alternative embodiment, the distal end of the arm is connected to the lip by first disposing a pad over an outward surface of the lip and then advancing the pad until it contacts the outward surface of the lip.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

FIG. 5A is a front view of the system of the current invention where two adjustable shelving racks have been disposed amongst a plurality of traverses which define a shelving unit.

FIG. 5B is a front view of the system seen in FIG. 5A after each of the adjustable shelving racks have been coupled to the plurality of traverses defining the shelving unit.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1A:
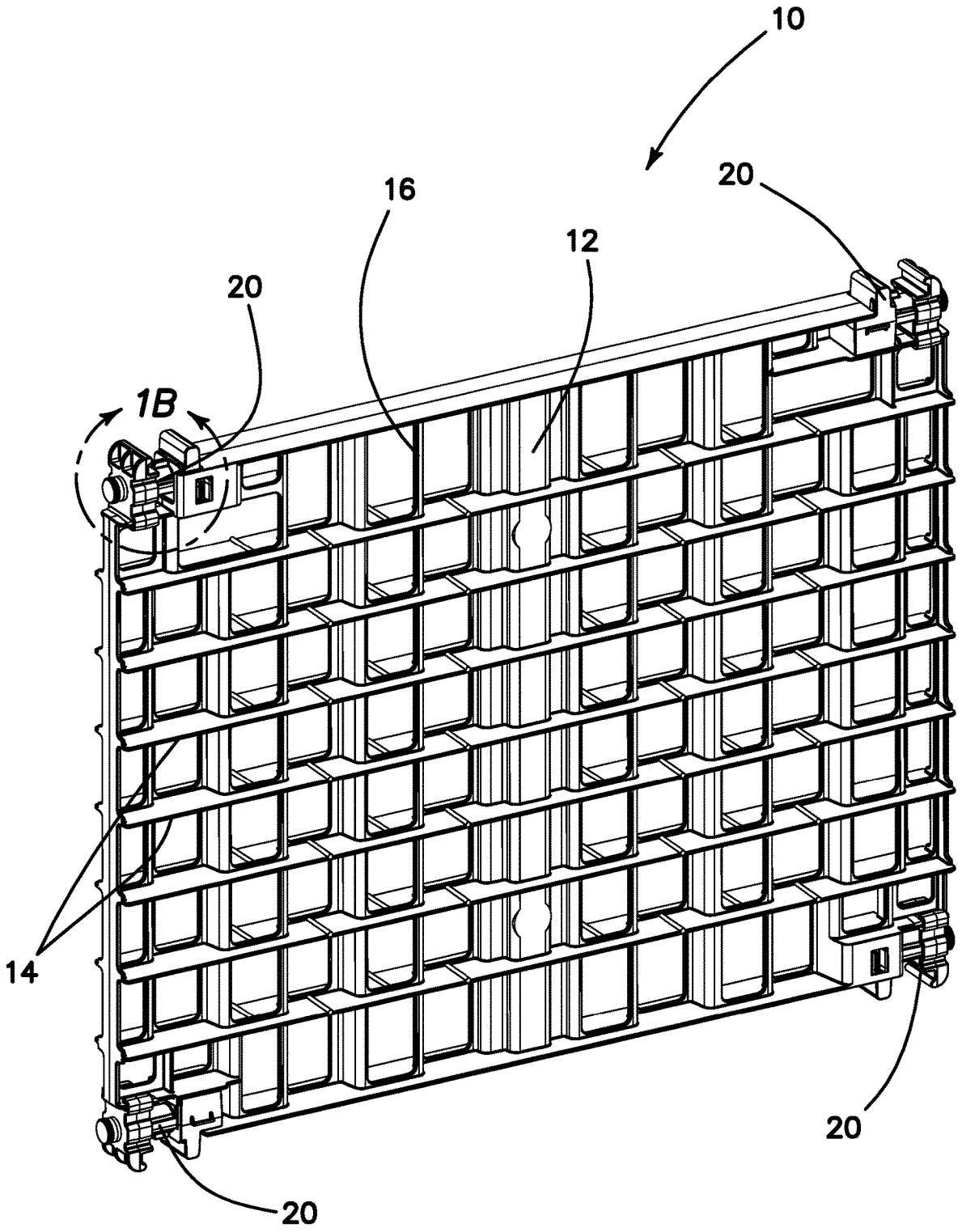
FIG. 1A is a perspective view of the adjustable shelving rack of the current invention comprising a panel and a plurality of coupling means.

The current invention solves the problems of the prior art and more by providing an adjustable shelving rack which is denoted generally by reference numeral 10 in FIG. 1A. The shelving rack 10 is comprised of a substantially rectangular panel 12 which itself is comprised of a lattice work, grid, or pattern of horizontal supports 14 and vertical supports 16. Each horizontal support 14 extends from either side of the surface of a geometric plane defined by the panel 12. Disposed in each corner of the panel 12 is a vice assembly 20 for coupling the shelving rack 10 to at least one traverse of a shelving unit 100 as detailed further below and in FIGS. 5A, 5B, 7A, and 7B. The vertical supports 16, the horizontal supports 14, and the vice assemblies 20 of the shelving rack 10 are each preferably comprised of injection molded plastic or plastic composites. Specifically, the panel 12 of the shelving rack 10 is preferably comprised of a single or integrated piece of injection molded plastic so as to provide maximum structural integrity and strength for the shelving rack 10.

Figure 1B:
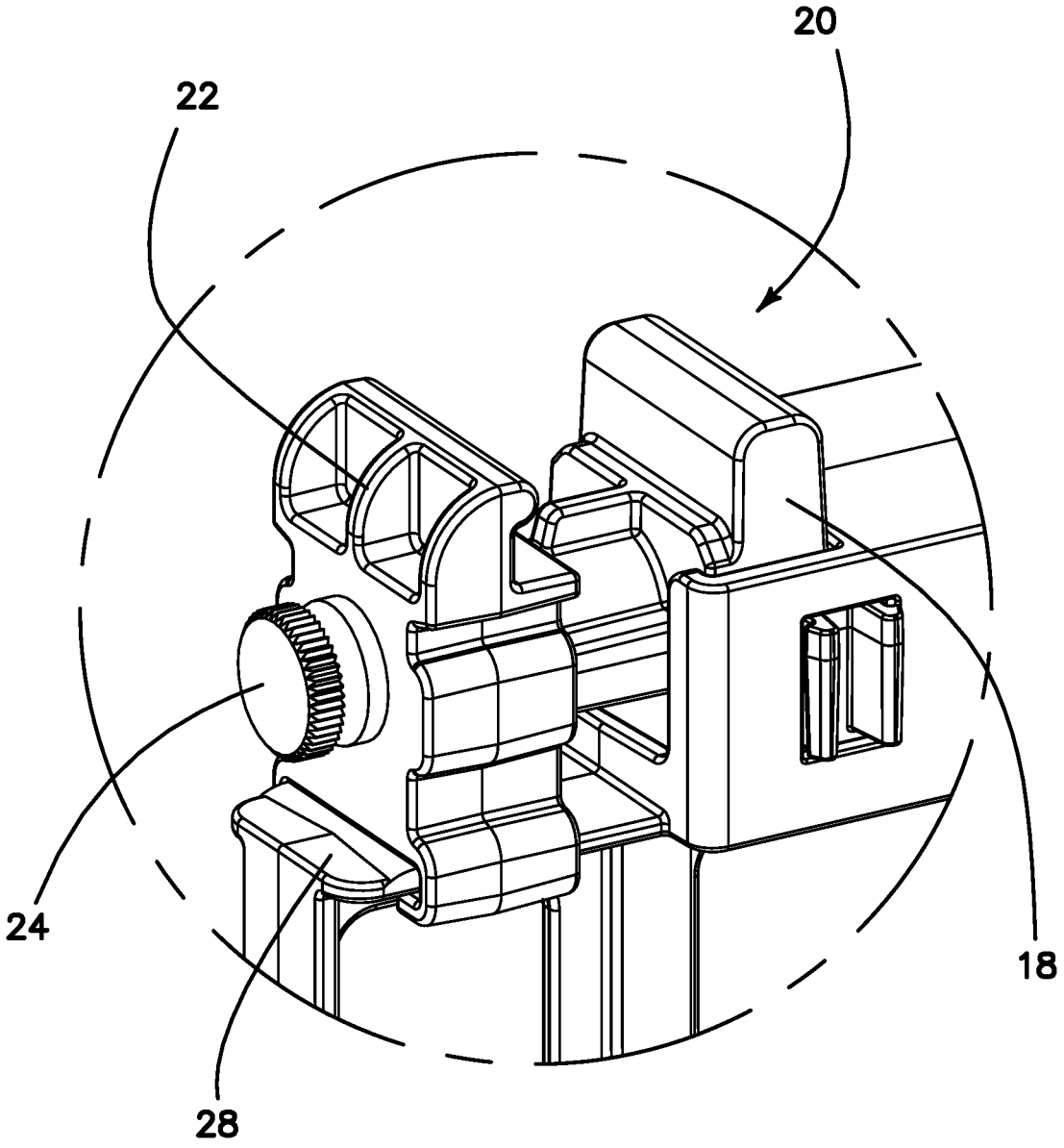
FIG. 1B is a magnified perspective view of one of the plurality of coupling means seen in FIG. 1A.

In the magnified view of a vice assembly 20 seen in FIG. 1B, each vice assembly 20 is comprised of a fixed clamp 18 coupled to a recess 26 defined within each one of the four corner portions of the panel 12. A moveable clamp 22 is in turn coupled to the panel 12 and is adjustable relative to the fixed clamp 18 via a coupling means, for example a threaded bolt 24 in one preferred embodiment.

Figure 3A:
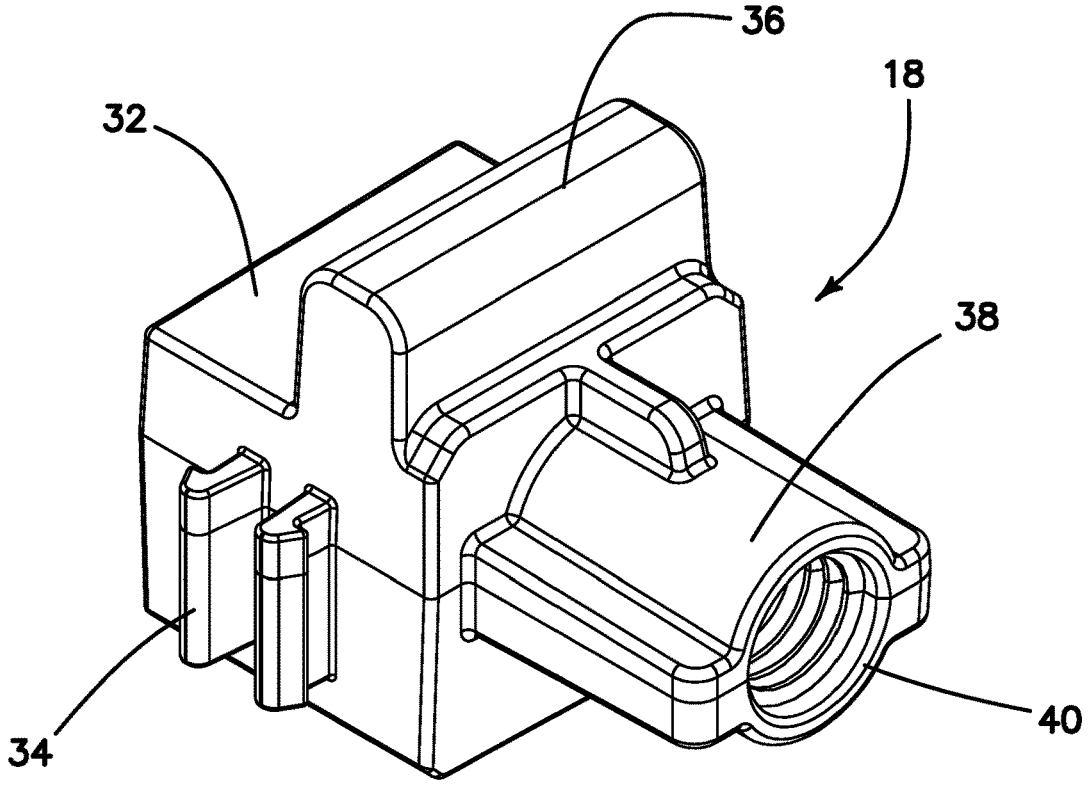
FIG. 3A is a perspective view of the fixed clamp portion of the coupling means seen in FIG. 1B.
Figure 3B:
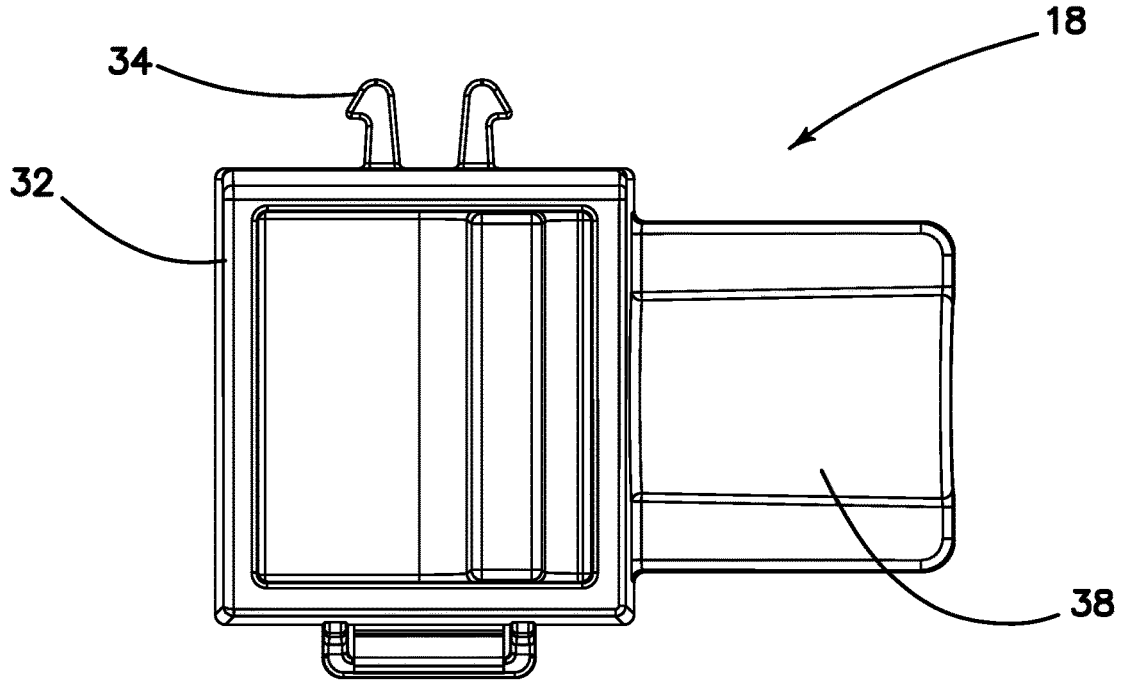
FIG. 3B is a bottom view of the fixed clamp seen in FIG. 3A.

Greater detail of the fixed clamp 18 may be seen in FIGS. 3A and 3B. Each fixed clamp 18 comprises a body 32 with a substantially cylindrical coupling portion 38 which extends outwardly from one surface of the body 32. The coupling portion 38 in turn comprises a female aperture or thread 40 disposed throughout the internal longitudinal length of the coupling portion 38. The body 32 further comprises a first jaw 36 disposed on or integrally formed on a top surface or top portion of the body 32. Additionally, disposed on one lateral side of the body 12 is a pinch or dual-prong clip 34 used to couple the fixed clamp 18 to the panel 12 as is discussed further below. As seen in the bottom view of the fixed clamp 18 of FIG. 3B, the dual-prong clip 34 comprises two flexible prongs with a pair of substantially hook-shaped or barbed tips that are symmetrically disposed in a substantially mirror-image configuration.

Figure 4A:
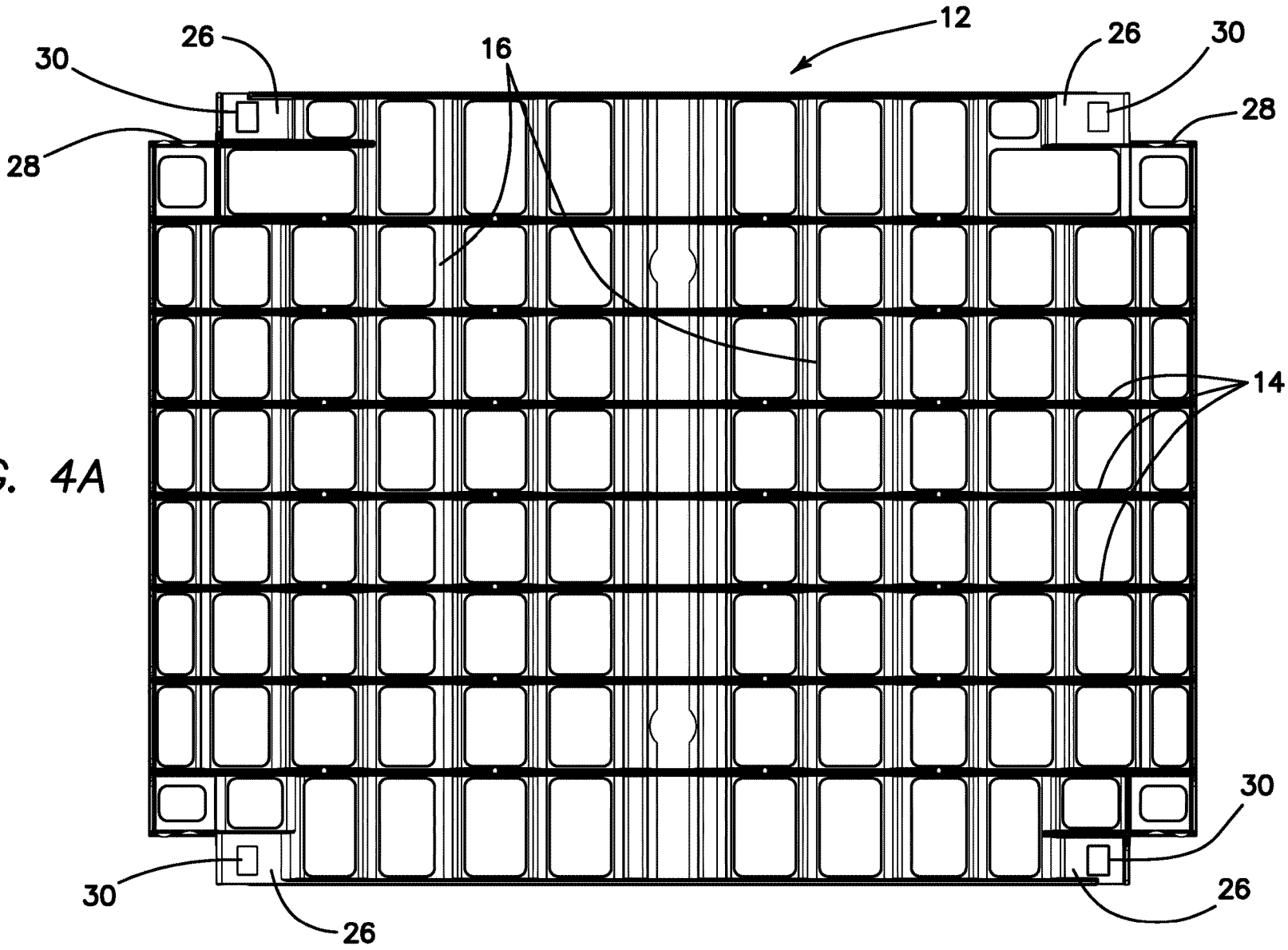
FIG. 4A is a side view of the panel portion of the adjustable shelving rack seen in FIG. 1A.
Figure 4C:
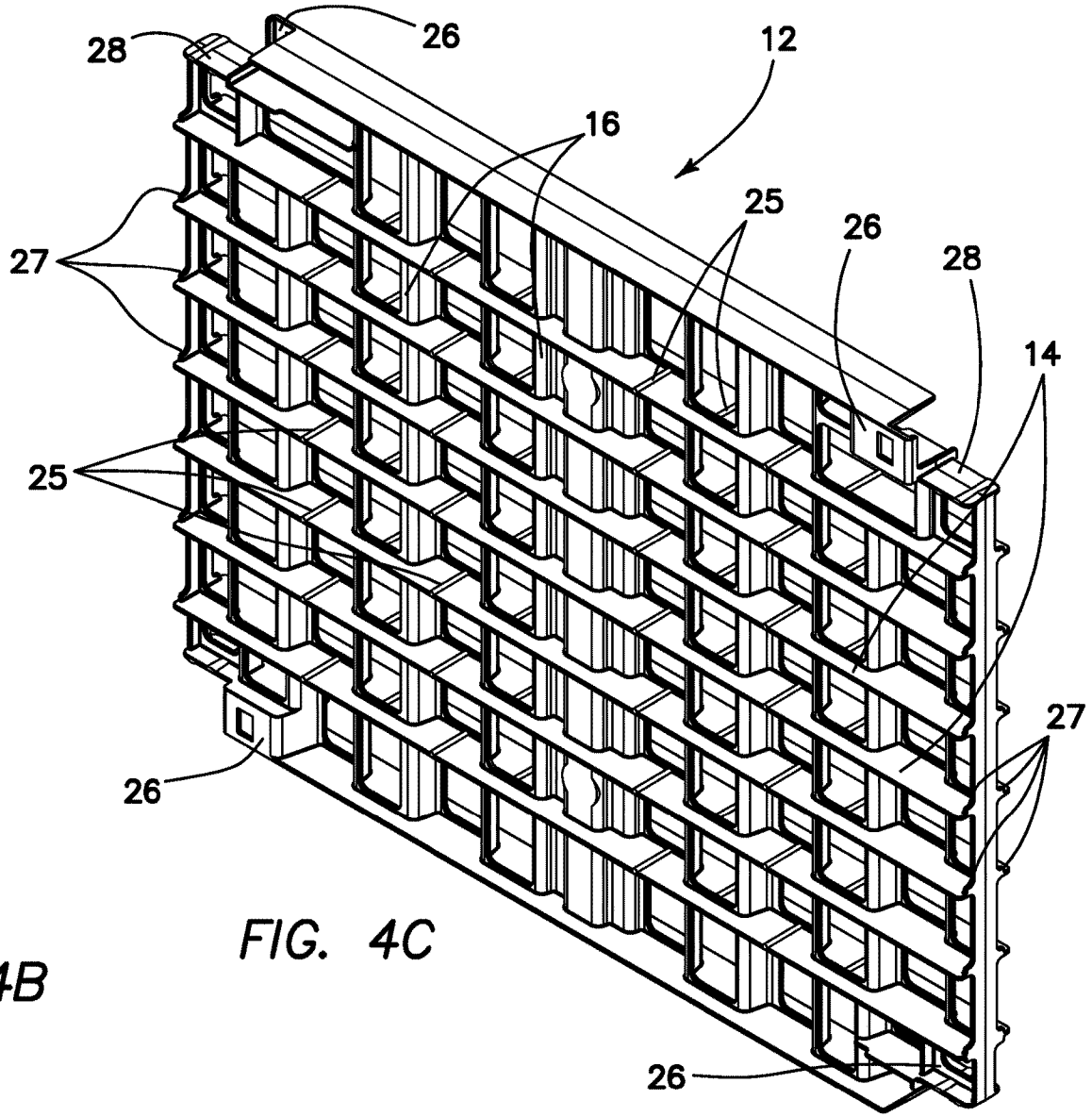
FIG. 4C is a perspective view of the panel seen in FIG. 4A.
Figure 4B:
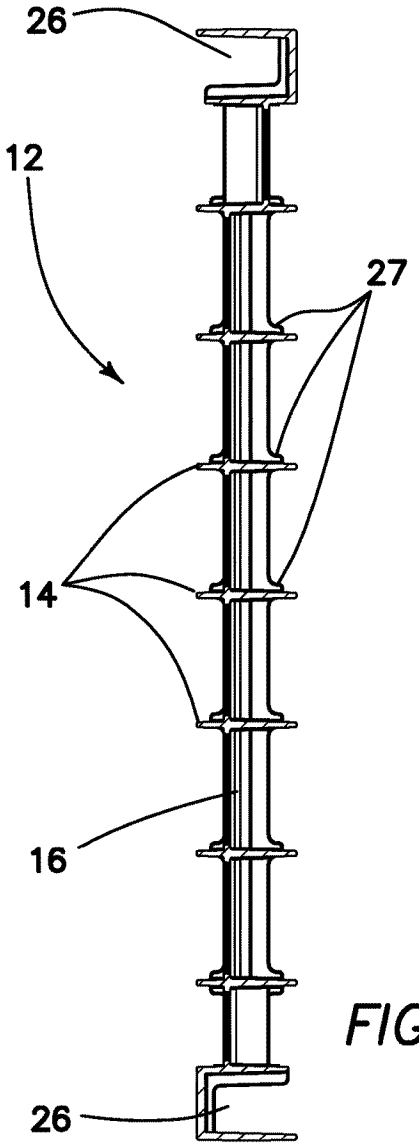
FIG. 4B is a front view of the panel seen in FIG. 4A.

More detail related to the panel 12 may be had by turning to FIGS. 4A-4C. Each panel 12 comprises a mold or recess 26 formed in each of the four corners of the panel 12. Each recess 26 in turn comprises an opening, cut out, or window 30 defined therein. Each vertical support 16 comprises a substantially asymmetrical, "zig zag", or non-linear shape which increases the stiffness or rigidity of the panel 12 which in turn increases the overall structural strength of the shelving rack 10. Additionally, each horizontal support 14 comprises a plurality of heat dispersing ridges, perturbances, or bumps 25 that are symmetrically disposed across the length of each respective horizontal support 14. Disposed at either end of each of the horizontal supports 14 is a pair of substantially symmetrical tray halts or stoppers 27. As best seen in FIGS. 4A and 4C, the longitudinal length of each of the plurality of horizontal supports 14 extend beyond the respective lateral positions of the each of the recess 26. In FIG. 4B, it can be seen how each substantially horizontal support 14 extends outward in a perpendicular direction relative to the vertical supports 16 on either side of the panel 12. It can also be seen that each recess 26 comprises a substantially curved, or "C" shaped cross section for accommodating the body 32 of the fixed clamp 18 therein without enlarging the profile of the shelving rack 10.

Figure 2A:
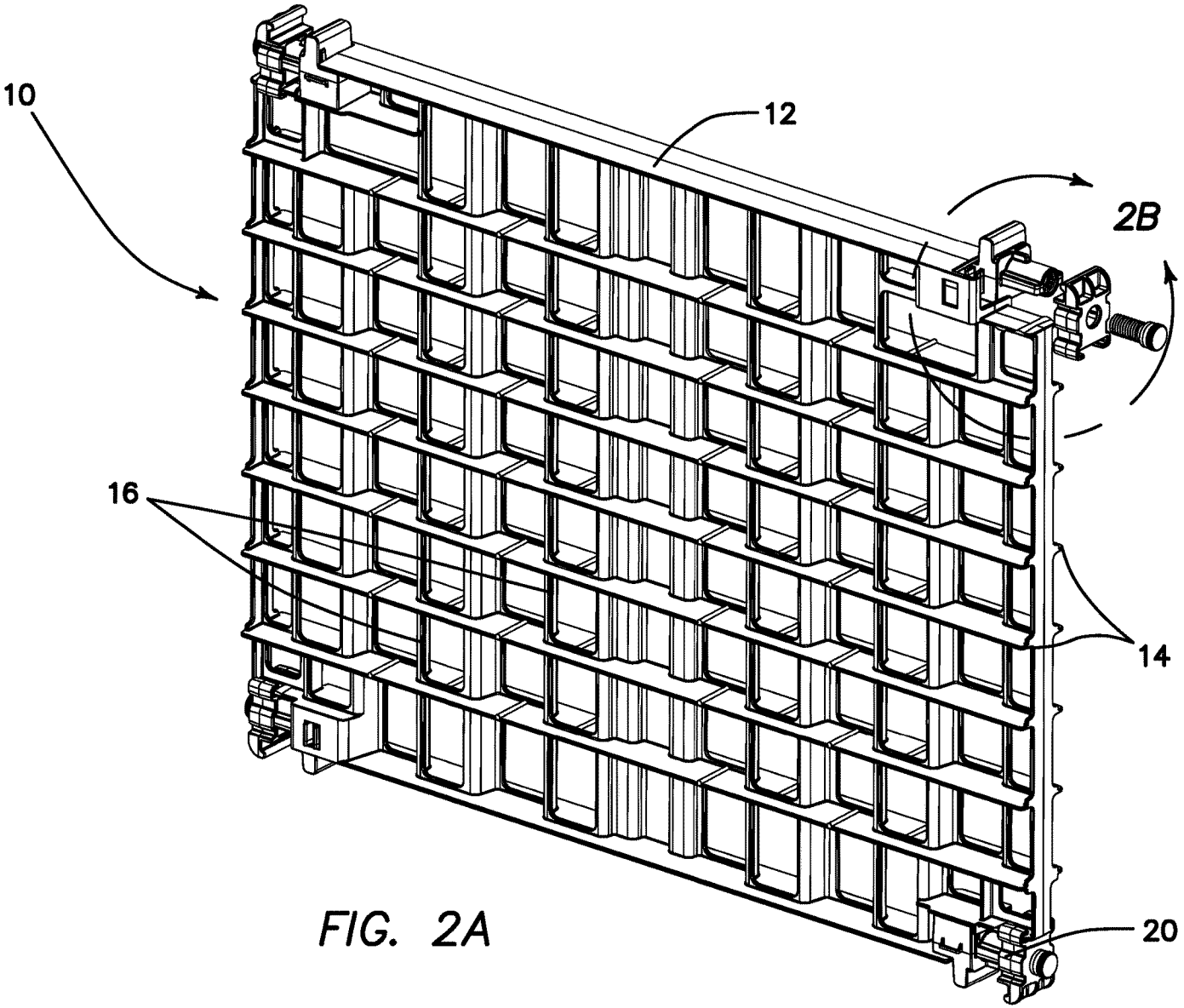
FIG. 2A is a partially exploded perspective view of the adjustable shelving rack seen in FIG. 1A.
Figure 2B:
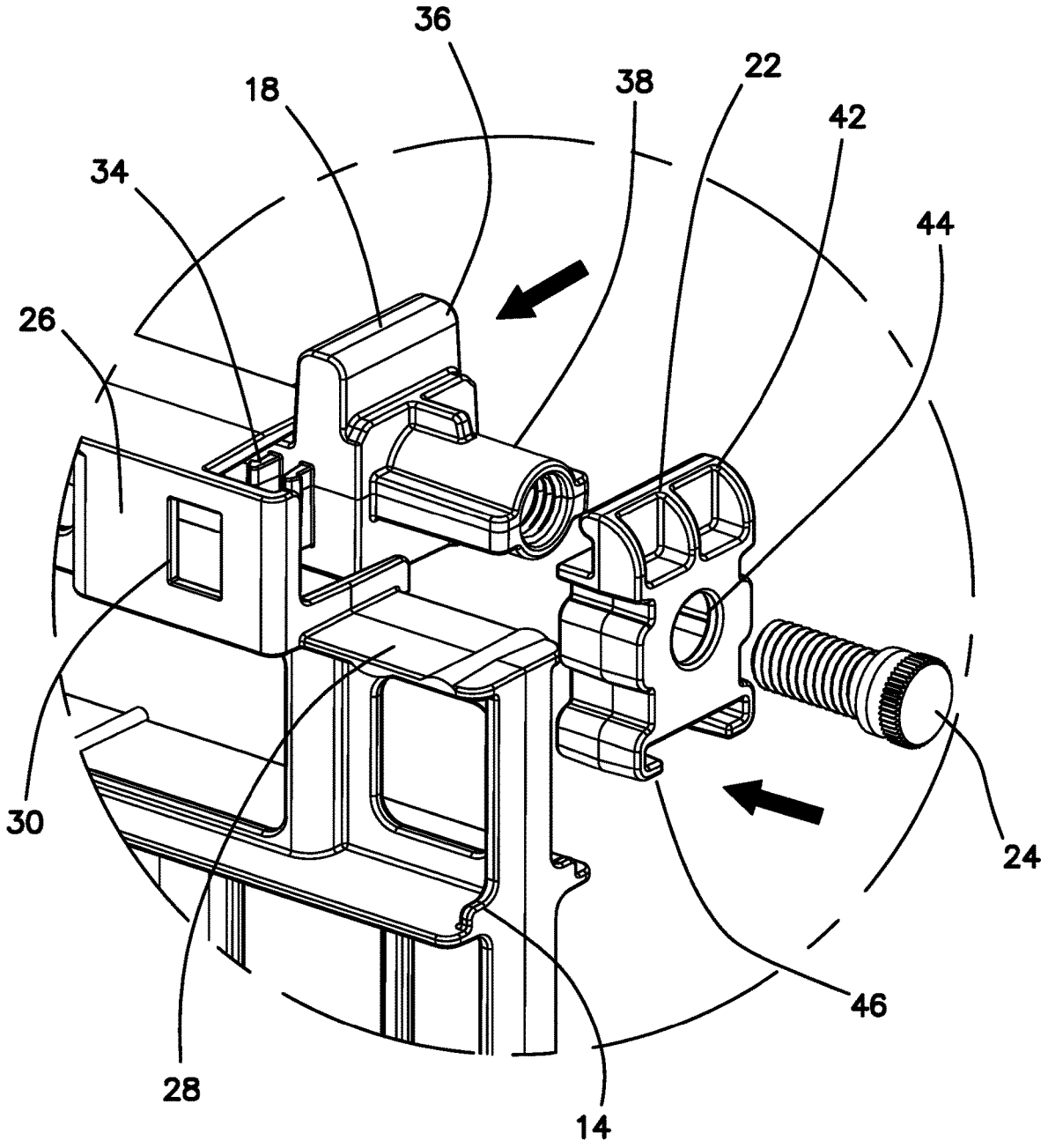
FIG. 2B is a magnified partially exploded perspective view of one of the plurality of coupling means seen in FIG. 2A.

As seen in greater detail in the partially exploded views of FIGS. 2A and 2B, each fixed clamp 18 is coupled to a recess portion 26 by inserting the dual-prong clip 34 into the window 30. As the pinch or dual-prong clip 34 is inserted into the window 30, each prong is pushed towards each other in order to fit through the narrower window 30. Once inserted, the natural spring force or resiliency of the dual-prong clip 34 pushes each prong away from each other into its natural or resting position. The hook-shaped tips of each prong then ensure that the fixed clamp 18 cannot decouple unintentionally from the recess 26 of the panel 12.

Figure 3C:
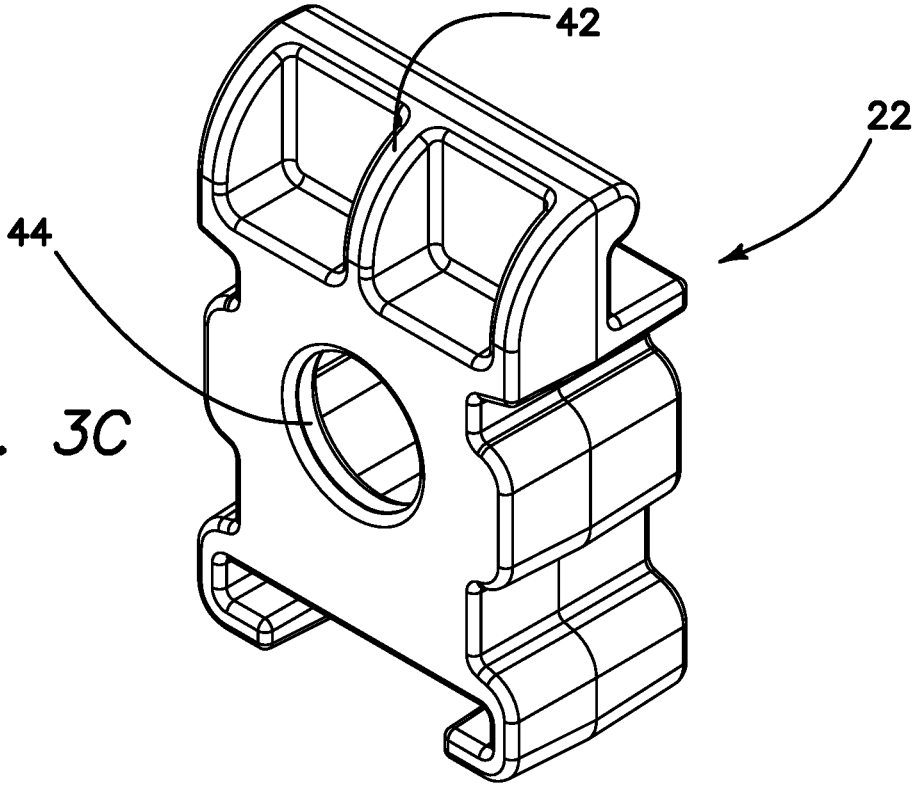
FIG. 3C is a perspective view of the moveable clamp portion of the coupling means seen in FIG. 1B.
Figure 3D:
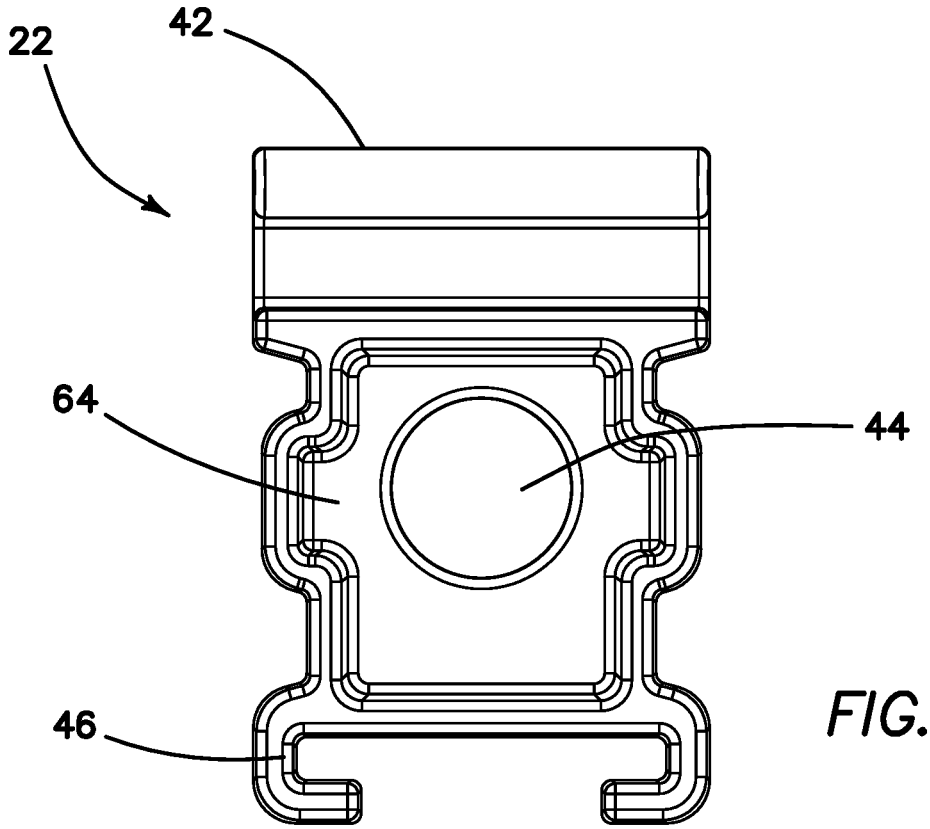
FIG. 3D is a rear view of the moveable clamp seen in FIG. 3C.

The movable clamp 22 is coupled to the fixed clamp 18 by sliding a hollow interior 64 defined in the center of the movable clamp 22 as seen in FIG. 3D over the coupling portion 38 and then inserting the threaded bolt 24 through an aperture 44 and then into the female thread 40 of the coupling portion 38. The threaded bolt 24 is then rotated or actuated in the clockwise direction within the female thread 40 of the coupling portion 38 which pushes or slides the moveable clamp 22 towards the fixed clamp 18, thereby bringing a second jaw 42 of the movable clamp 22 closer and closer to the first jaw 36 of the fixed clamp 18. When the threaded bolt 24 is rotated in the opposing or counterclockwise direction, the movable clamp 22 is backed off or separated from the fixed clamp 18 which in turn widens the gap between the first jaw 36 and the second jaw 42. As the movable clamp 22 is being adjusted via the threaded bolt 24, a bracket 46 extending vertically downward from the movable clamp 22 as best seen in FIGS. 3C and 3D is simultaneously moved back and forth over a tab 28 extending outward from beneath the recess 26. Specifically, as the movable clamp 22 is moving towards the fixed clamp 18, the tab 28 is also inserted into the bracket 46. The interlocking fit created between the tab 28 and the bracket 46 ensures that any rotational movement between the panel 12 and the movable clamp 22 is prevented while the threaded bolt 24 is rotated.

It should also be noted that in alternative embodiments that the threaded bolt 24 may further comprise a wing nut, an extended surface, or another type of flange which extends outward from the longitudinal length of the threaded bolt 24 so as to provide a user with the ability to apply a greater amount of torque and thus make rotation of the threaded bolt 24 easier.

Figure 6A:
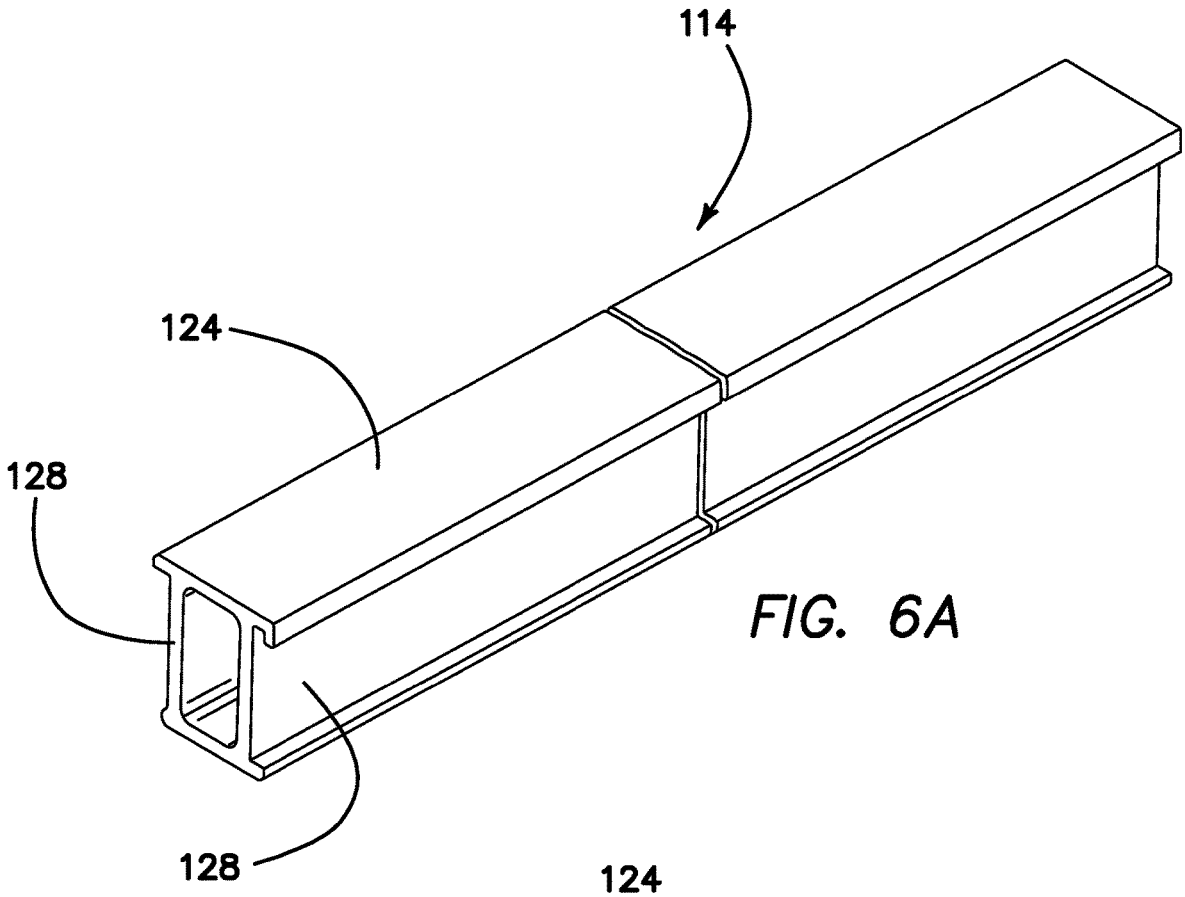
FIG. 6A is a perspective view of a traverse which define the shelves of the shelving unit.
Figure 6B:
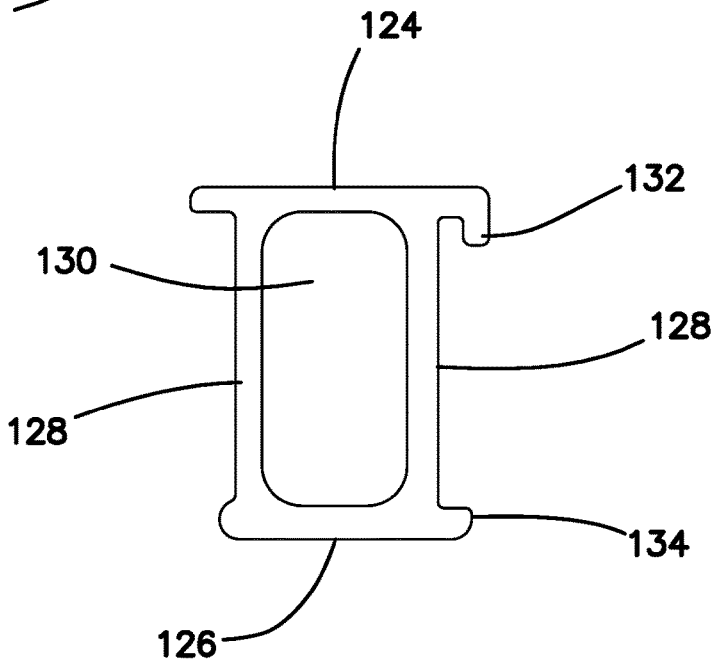
FIG. 6B is an end view of the traverse seen in FIG. 6A.

The adjustable shelving rack 10 is coupled to or disposed within a shelving unit 100 comprised of a plurality of substantially vertical posts 112 and a plurality of substantially horizontal traverses 114. Greater understanding of the traverses 114 of the shelving unit 100 can be had by turning to FIGS. 6A and 6B. Each traverse 141 is substantially shaped in a hollow double I-beam configuration as seen in the cross section of FIG. 6B. The double I-beam configuration comprises a top surface 124, a bottom surface 126, and two side walls 128 with a hollow cavity 130 defined there between and throughout the length of the traverse 114. Each traverse 114 also comprises a downturned lip 132 adjacent to the top surface 124 and an extended segment 134 adjacent to the bottom surface 126 throughout its length. Preferably, the lip 132 faces "outward" or to the "outside" of the shelving unit 100, namely on the opposite side of the traverse 114.

The vertical posts 112 and horizontal traverses 114 of the shelving unit 100 are made by a pultrusion process comprising the following steps of providing a supply of fiberglass rovings, guiding fibers from the fiberglass rovings through a resin impregnator, saturating the fibers with resin from the resin impregnator, pulling the saturated fibers through a forming die, forming the fibers to a predetermined shape to form a pultruded component, and cutting the formed pultruded traverse or post to a predetermined length. Specifically, both the primary horizontal traverses 114 and the primary vertical posts 112 are comprised of plastic or plastic composites and are fabricated by the known process of pultrusion.

The process of pultrusion in general includes a plurality of strands of fiberglass or other suitable material being extruded from a plurality of rovings disposed on a rack by a plurality of pulleys or other suitable means. The strands of fiberglass are brought together with other materials such as mats and are placed in a resin bath or are otherwise impregnated with resin and other substances that bind the roving strands together in a resin impregnator. The resin may either be liquid or powder based depending on the type of fiberglass material being supplied by the rovings, and may include a mixture of one or more thermosetting or thermoplastic resins. Various types of filament winding may be added if desired to the resin infused strands by an in-line winder. Adding a filament winding increases the bi-axial strength of the pultruded component. The resin infused strands are then mechanically pulled by a set of roving pullers through a set of performers which help the fiberglass rovings obtain an initial rough shape before being pulled through a curring die which forms the fiberglass to a permanent predetermined shape. After being pulled, heated, or cured, a saw then cuts the pultruded component down to a desired length or plurality of lengths.

In the preferred embodiment of the current invention, the horizontal traverses 114 and vertical posts 112 are comprised of a mixture of 70% to 80% glass and 20% to 30% resin. The fiberglass being fed from the rovings is a continuous filament of 2025 Fiber glass. As the fiberglass enters the resin impregnator 176, a resin comprising 50% BAYDUR PUL2500 (Polymeric Diphenylmethane Diisocyanate (pMDI)), 47.32% BAYDURE PUL2500 (Polyol System), 2.07% mold release (AXEL INT-1948MCH), and 0.25% color load (REBUS Code 70165) is impregnated onto the fiberglass. After each of the components have been properly cured, molded, and cut, the resulting product is an extremely strong and durable structural element for the shelving system 100 that is still lightweight enough to be easily carried or otherwise manipulated. It is to be expressly understood however that other similar types of fiberglass or resins may be used in differing proportions from what is listed here without departing from the original spirit and scope of the invention.

In the embodiment best seen in FIGS. 5A and 5B, the horizontal traverses 114 are paired up in parallel groups of two and are coupled to vertical posts 112 at either end of each traverse 114. Each parallel pair of traverses 114 forms a support structure or a frame for a shelf or level within the larger shelving unit 100. Each parallel pair of traverses 114 may accommodate a plurality of adjustable shelving racks 10. It should also be noted that fewer or additional traverses 114 other than what is explicitly shown in FIGS. 5A and 5B may be used without departing from the original spirit and scope of the invention. For example, FIG. 5A shows two pairs of parallel traverses 114 thereby providing at least one frame or support for at least one shelving space, however additional pairs of traverses 114 may be present thereby providing more options for the user to dispose adjustable shelving racks 10 at different levels or heights within the shelving unit 100.

To incorporate an adjustable shelving rack 10 into the shelving unit 100, the user inserts the adjustable shelving rack 10 in between two vertical pairs of traverses 114 as seen in FIG. 5A by first disposing the vice assemblies 20 on one longitudinal edge of the shelving rack 10 over the width of a corresponding parallel pair of traverses 114. Specifically, each vice assembly 20 is initially disposed in an open configuration with the movable clamp 22 backed off or separated from the fixed clamp 18 so that the top surface 124 of the lower traverses 114 may be fitted or inserted therein. The shelving rack 10 is then rotated or pivoted in the direction shown by arrow 48 which brings the vice assemblies 20 on the opposing longitudinal edge of the shelving rack 10 into close proximity with the bottom surface 126 of the upper pair of traverses 114. Next the user actuates the thumb screw 24 of each vice assembly 20 together or in succession to bring each corresponding movable clamp 22 and fixed clamp 18 together as discussed above. As the movable clamp 22 moves toward the fixed clamp 18, the first jaw 36 is pressed against an inside edge of each traverse 114 while the second jaw 42 is simultaneously pressed against the corresponding outside edge of each traverse 114 as each vice assembly 20 is actuated. In other words, actuating each vice assembly 20 of the shelving rack 10 forces the fixed clamp 18 and the movable clamp 22 to pinch, grip, or otherwise squeeze the traverse 114 it is disposed on. When all four vice assemblies 20 have been tightened, the adjustable shelving rack 10 is firmly held in place between the two adjacent pairs of parallel traverses 114 thus sub dividing the storage space or volume defined by the frame of the shelving unit 100, namely the horizontal traverses 114 and the vertical posts 112. For example, by placing two adjustable shelving racks 10 within a single shelving area of a shelving unit 100 as seen in FIG. 5B, the user may divide a single storage area into three separate storage sub-areas, namely sub-area A, sub-area B, and sub-area C. By repeating the process and installing a plurality of adjustable shelving racks 10 on all the pairs of traverses 114 which may be present within the shelving unit 100, the user can sub divide the shelving unit 100 into as many compartments or sub-areas as they desire or is needed.

To adjust the relative position of any adjustable shelving rack 10 within the shelving unit 100, the user loosens or adjusts each of the thumb screws 24 in each corresponding vice assembly 20 so that the first and second jaws 36, 42 are backed off of the inside and outside edges of each traverse 114, respectively. With both the top surface 124 and the bottom surface 126 of each traverse 114 still disposed between but not firmly contacting either the first jaw 36 and the second jaw 42 of each corresponding vice assembly 20, the user may slide, push, or otherwise move the adjustable shelving rack 10 in either lateral direction shown by arrows 50 and 52 in FIG. 5B. By keeping each vice assembly 20 disposed around but not firmly gripping the edges of the traverses 114, the user does not need to fully remove or extract the adjustable shelving rack 10 from the shelving unit 100 in order to adjust its relative position therein. Instead, the user simply loosens each vice assembly 20, slides the shelving rack 10 laterally down the length of the traverses 114 to a new desired position, and then retightens or reengages each vice assembly 20 to once again fix the adjustable shelving rack 10 to a stationary position within the shelving unit 100. To remove the adjustable shelving rack 10 completely, the user loosens or expands each vice assembly 20 and then rotates or pivots the adjustable shelving rack 10 in the opposing direction from the direction indicated by arrow 48. The shelving rack 10 may then be lifted from the shelving system 100 and cleaned or otherwise reinserted if needed.

Figure 8A:
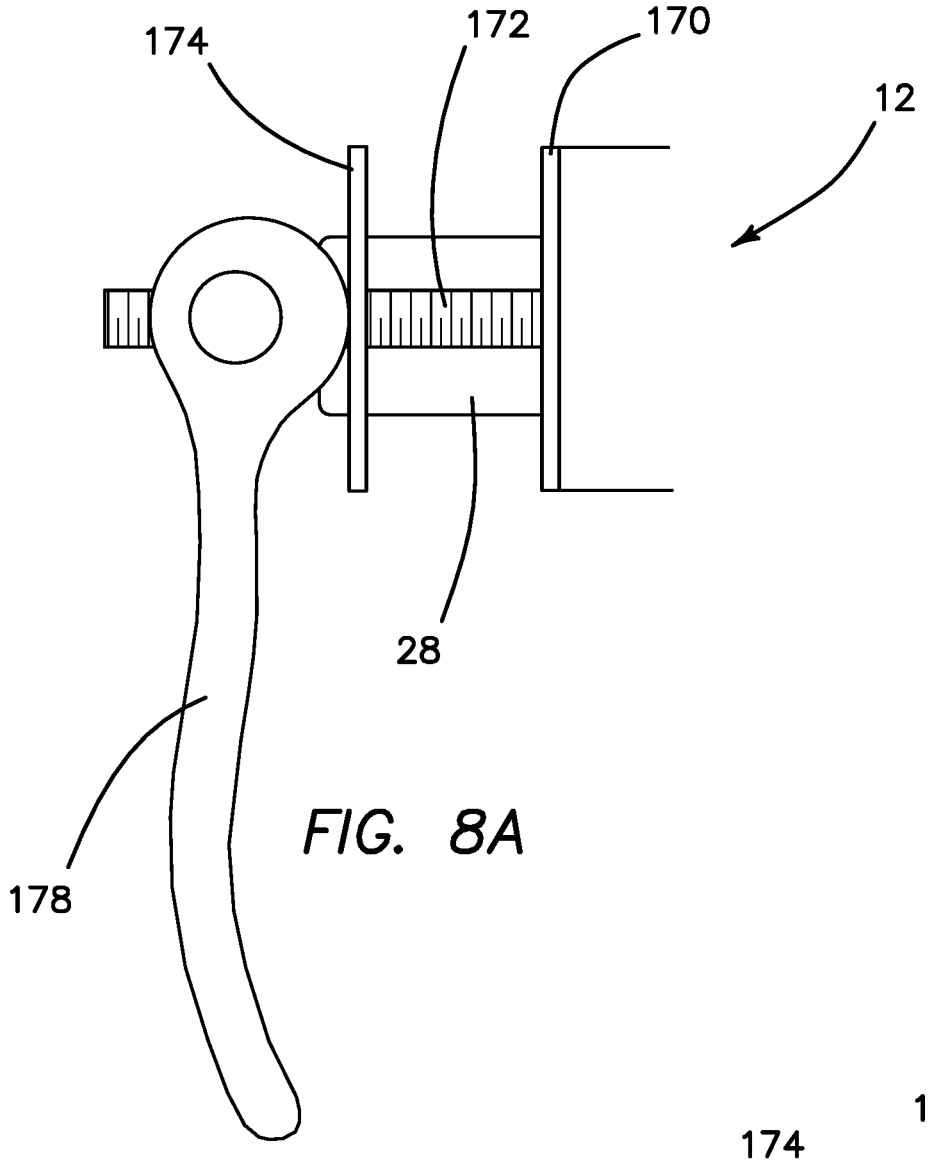
FIG. 8A is a top down perspective view of an alternative embodiment of the coupling means used to couple the adjustable shelving rack to a shelving unit comprising a cam lever.
Figure 8B:
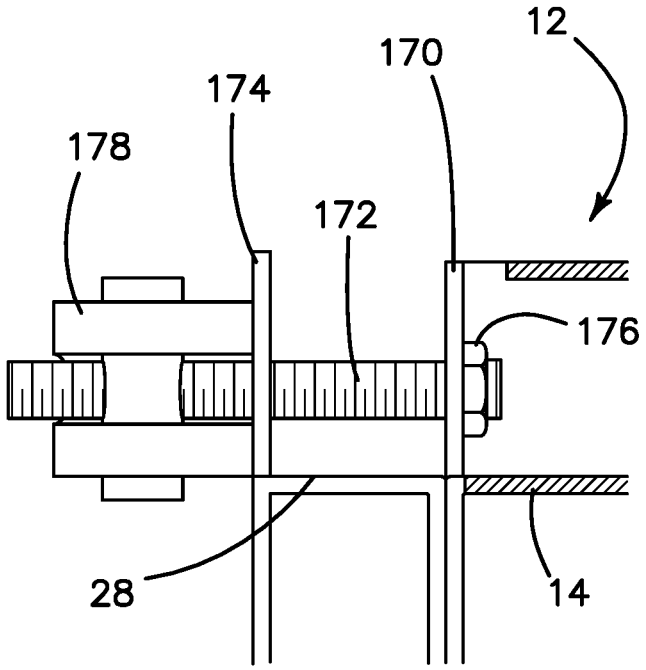
FIG. 8B is a side view of the alternative embodiment seen in FIG. 8A.

Alternatively, in a separate embodiment seen in FIGS. 8A and 8B, a cam lever or cam lock system may be used to couple each of the four corners of the panel 12 to a corresponding traverse 114. In this embodiment each of the recesses 26 is replaced entirely with a stationary surface or wall 170 which is disposed perpendicular relative to the substantially horizontal tab 28. A bolt 172 inserted through a moveable wall 174 is also inserted through the stationary wall 170 and held in place via a knob 176. Disposed on the opposing end of the bolt 172 is a cam lever 178 that, when actuated, changes the position of the movable wall 174 relative to the stationary wall 170. Specifically, when the cam lever 178 is in the "open" position, the movable wall 174 is pushed away from the stationary wall 170 thereby increasing the distance between the two. The panel 12 is then disposed on the shelving unit 100 so that a traverse 114 is placed in the space created between the moveable wall 174 and the stationary wall 170. The cam lever 178 is then actuated into the "closed" position which pushes the moveable wall 174 closer to the stationary wall 170 while simultaneously drawing the proximal end of the bolt 172 through the cam lever 178 as is known in the art. Actuating the cam lever 178 effectively applies a squeezing or gripping force to the traverse 114 disposed there between and locks the corresponding corner or edge of the panel 12 to that respective position along the longitudinal length of the traverse 114. To remove the panel 12 from the traverse 114 or simply readjust its longitudinal position along the traverse 114, the cam lever 178 is moved back into the open position which releases the grip applied to the traverse 114. The position of the panel 12 is then adjusted as needed and then locked back into position by again closing or re-actuating the cam lever 178.

Figure 9A:
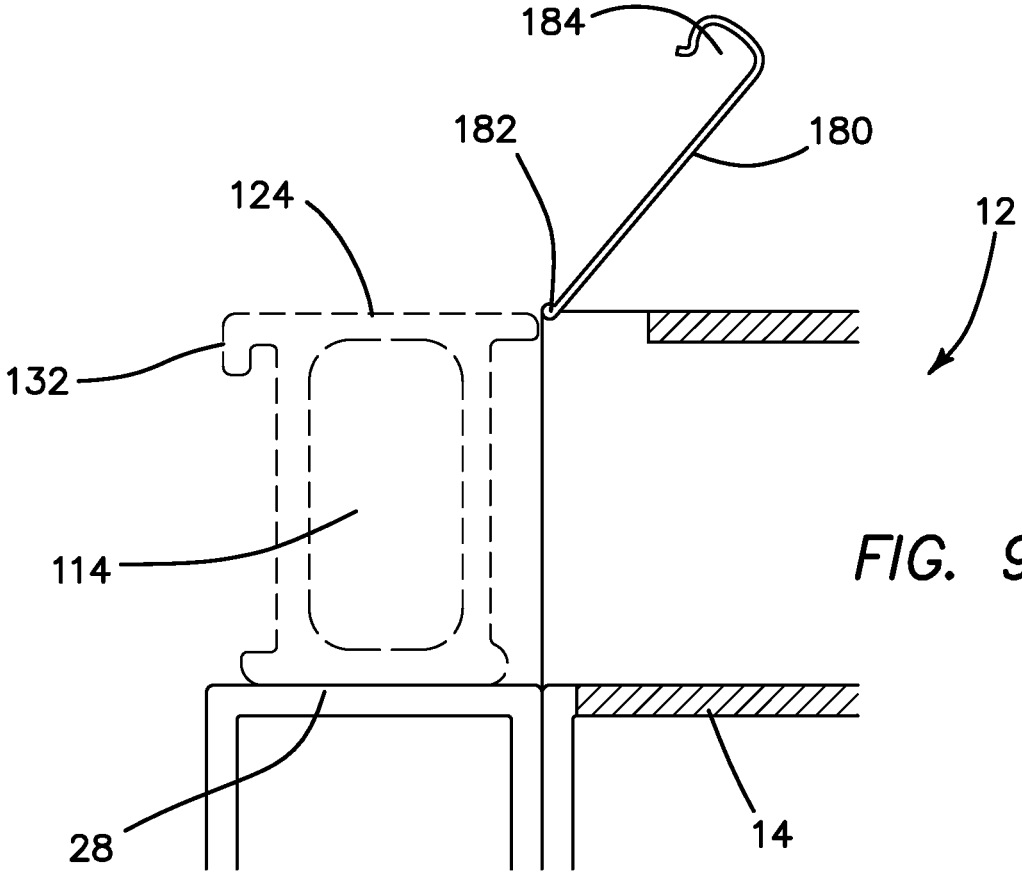
FIG. 9A is a side view of an alternative embodiment of the coupling means used to couple the adjustable shelving rack to a shelving unit comprising a pivotable arm and a hook disposed at the distal end of the arm, the arm being in an open configuration.
Figure 9B:
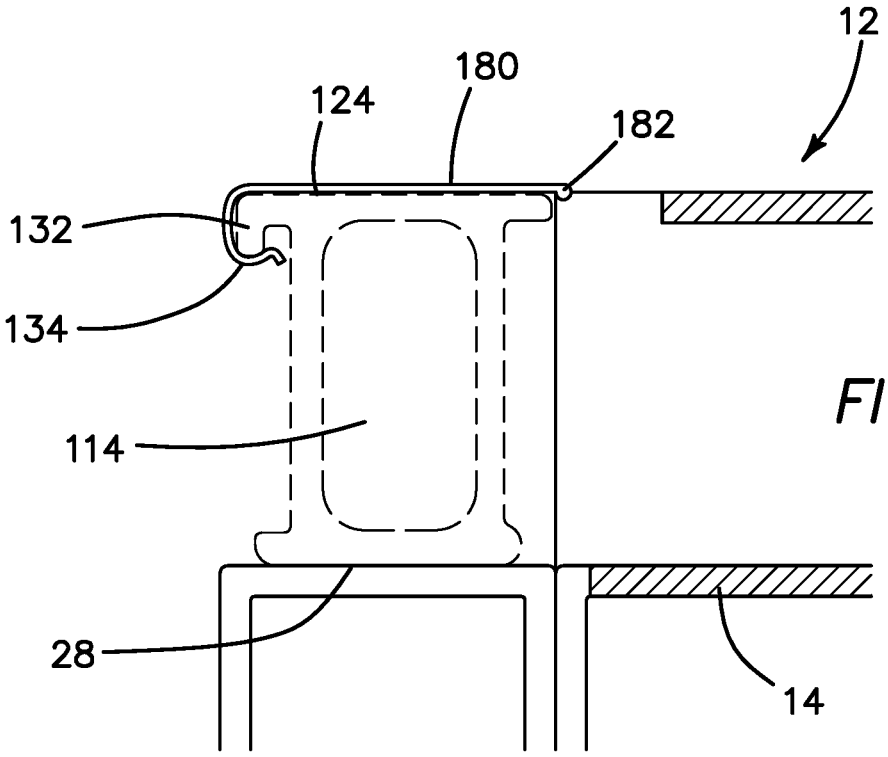
FIG. 9B is a side view of the alternative embodiment seen in FIG. 9A when the arm is placed in a closed position with the hook disposed at the distal end of the arm coupled to a lip disposed on a traverse of the shelving unit.

In an alternative embodiment, the panel 12 may be selectively coupled or locked to a traverse 114 is seen in FIGS. 9A and 9B. Here, an arm 180 is coupled to a portion of the panel 12 through a pivot or hinge 182. The arm 180 is rotatable or is otherwise able to pivot about the hinge 182.

As discussed above, a traverse 114 is placed or disposed within a cut out or aperture defined in each corner of the panel 12, preferably with a surface of the traverse 114 in contact with the tab 28. The arm 180 is then swung or pivoted over the top surface 124 of the traverse 114. As the arm 180 is placed over the traverse, a snap button or hook 184 disposed on a distal end of the arm 180 is placed in close proximity to the lip 132 that is disposed along the longitudinal length of the traverse 114. Pressure is applied to the hook 184 which causes the hook 184 which is comprised of a flexible yet resilient material to accommodate the lip 132 therein in a substantially friction or snap type fit. An audible "snap" or "click" sound may be emitted as the hook 184 fits around or accommodates the lip 132. The rounded or substantial "U" shape of the hook 184 ensures that the lip 132 remains within the hook 184 for as long as the panel 12 remains coupled to the traverse 114. To remove the panel 12 from the traverse 114 or simply readjust its longitudinal position along the traverse 114, the distal end of the hook 184 is manipulated so as to move the hook 184 off of the lip 132 of the traverse 114. The arm 180 may then be swung or moved back off of the top surface 124 of the traverse 114, thereby clearing the way for the panel 12 to be removed from the traverse 114. The position of the panel 12 is then adjusted as needed and then locked into a new position by again snapping the hook 184 over the lip 132 after rotating or swinging the arm 180 back over the traverse 114 via the hinge 182.

Figure 10A:
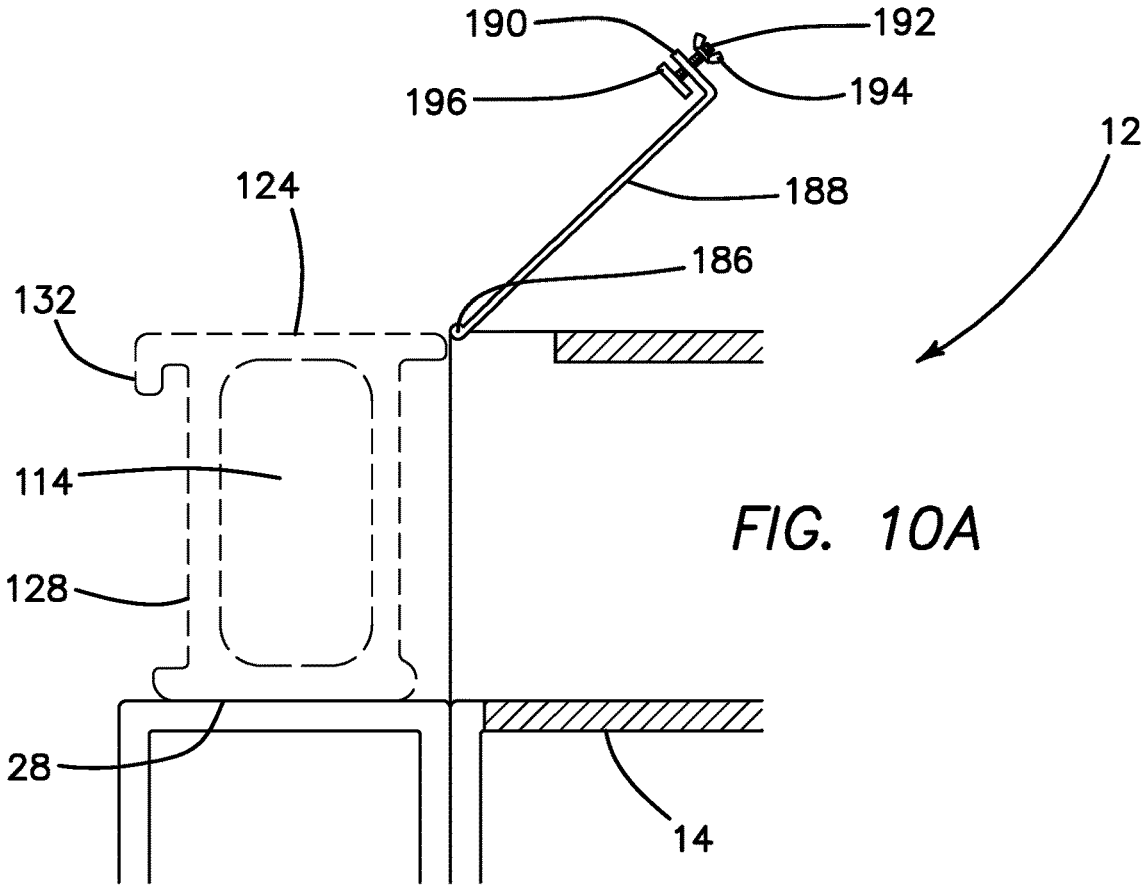
FIG. 10A is a side view of an alternative embodiment of the coupling means used to couple the adjustable shelving rack to a shelving unit comprising a pivotable arm with an adjustable flange bolt and pad disposed at the distal end of the arm, the arm being in an open configuration.
Figure 10B:
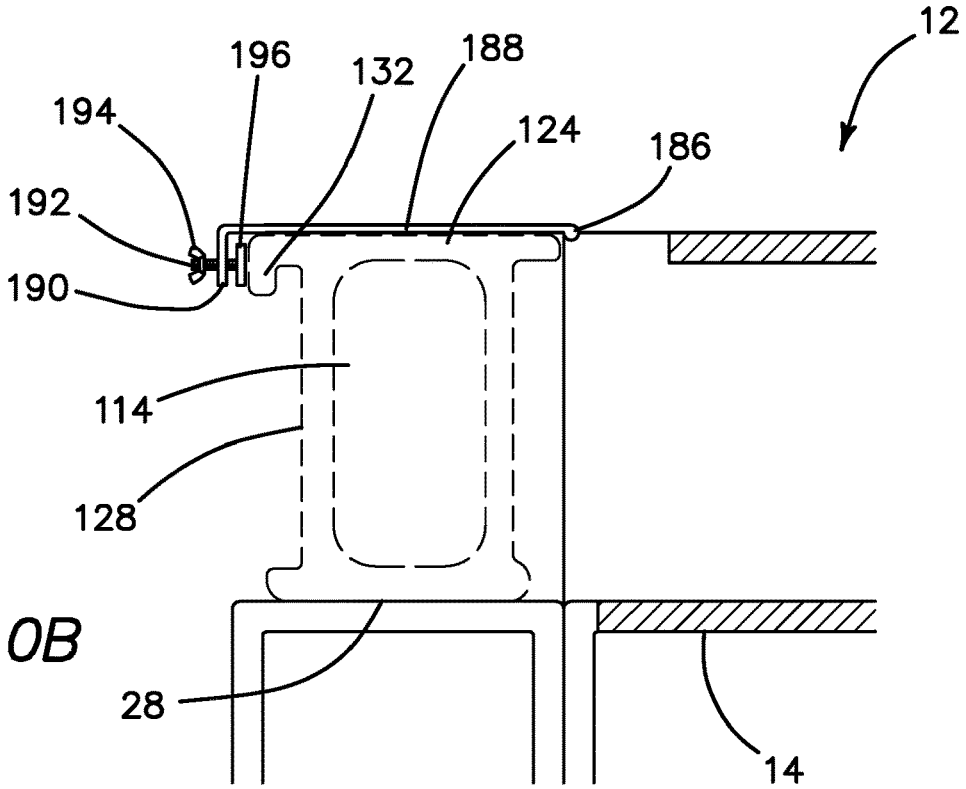
FIG. 10B is a side view of the alternative embodiment seen in FIG. 10A when the arm is placed in a closed position with the pad disposed at the distal end of the arm placed in front of an outward facing surface of a lip disposed on a traverse of the shelving unit.

In a related but separate embodiment of how the panel 12 may be selectively coupled or locked to a traverse 114 may be seen in FIGS. 10A and 10B. Here, an arm 188 is coupled to a portion of the panel 12 through a pivot or hinge 196. The arm 188 is rotatable or is otherwise able to pivot about the hinge 196. Disposed at a distal end of the arm 188 is a flange 190 which is orientated to be substantially perpendicular or orthogonal relative to the arm 188. Inserted through the flange 190 is a threaded flange bolt 192 which in turn comprises a pad 196 disposed on one side of the flange 190 and a wing nut 194 disposed on the opposing side of the flange 190. The wing nut 194 is engaged with the threaded flange bolt 192 allowing it to be rotated about the flange bolt 192 while the pad 196 is coupled to the flange bolt 192 at a fixed position at the distal end of the flange bolt 192.

As discussed above, a traverse 114 is placed or disposed within a cut out or aperture defined in each corner of the panel 12, preferably with a surface of the traverse 114 in contact with the tab 28. The arm 188 is then swung or pivoted over the top surface 124 of the traverse 114. As the arm 188 is placed over the traverse, the flange 190 portion of the arm 188 is naturally disposed or placed in close proximity to the lip 132 disposed along the longitudinal length of the traverse 114. The wing nut 194 is actuated in a first direction which causes the flange bolt 192 to advance through the flange 190 which in turn advances the pad 196 toward the outward facing surface of the lip 132. The wing nut 194 is actuated until the pad 196 makes firm contact with the outward facing surface of the lip 132, thereby locking that particular corner of the panel 12 to that specific position along the length of the traverse. To remove the panel 12 from the traverse 114 or simply readjust its longitudinal position along the traverse 114, the wing nut 194 is actuated in an opposing second direction so as to retract or move the pad 196 off of the lip 132 of the traverse 114. The arm 188 may then be swung or moved back off of the top surface 124 of the traverse 114, thereby clearing the way for the panel 12 to be removed from the traverse 114. The position of the panel 12 is then adjusted as needed and then locked into a new position by once again tightening the pad 196 against the lip 132 after rotating or swinging the arm 188 back over the traverse 114 via the hinge 186. While FIGS. 10A and 10B illustrate how the flange 190 places the pad 196 in a position to be tightened or pressed against the outward facing surface 132, in a related embodiment it is expressly understood that the flange 190 may comprise a longer length than is currently seen, thereby positioning the flange bolt 192 and pad 196 to be advanced towards and pressed against a side wall 128 of the traverse 114 instead of the lip 132.

In addition to separating a shelf within a shelving unit 100 into one or more sub-compartments or sub-areas for storage, the shelving rack 10 further provides structural support for the goods to be stored within the shelving unit 100 in a suspended stacked configuration. An alternative embodiment of the shelving unit 100' can be seen in FIGS. 7A and 7B comprising three separate shelves or levels 150, 152, 154, each level comprising a plurality of adjustable shelving racks 10 coupled to a corresponding plurality of traverses 114 which form each of the shelves 150, 152, 154. Each adjustable shelving rack 10 as disclosed above in turn comprises a plurality of horizontal supports 14 which, as seen in the frontal view of FIG. 7A, project or extend perpendicularly in the lateral direction from either side of the panel 12. The user may then dispose a plurality of food or item containers on each level 150, 152, 154 of the shelving system by aligning the container between the matching or parallel horizontal supports 14 of two adjacent adjustable shelving racks 10.

Specifically, the food or item container may be a food pan 50 which comprises an elevated lip or rim around the perimeter of the food pan 50 as is known in the art. The user selects at which height relative to the shelving rack 10 they wish to place the food pan 50 and then places the lip or rim of the food pan 50 on the horizontal support 14 of each adjacent shelving rack 10 which corresponds to that height. Once each side or edge of the food pan 50 is in contact with a corresponding horizontal support 14, the user then slides or pushes the food pan 50 distally away from themselves and deeper into the shelf or level 154 until the entire length of the food pan 50 is supported by each corresponding horizontal support 14. The food pan 50 may then be released by the user, thereby leaving the food pan suspended and supported by shelving racks 10. The food pan 50 specifically rests on the plurality of heat dispersing bumps 25 disposed on each of the corresponding horizontal supports 14 so as to prevent the transfer of heat between the food pan 50 and the shelving racks 10. The pair of tray stoppers 27 disposed on either end of the horizontal supports 14 help ensure that the food pan 50 is not inadvertently slid off of the horizontal supports 14. To remove the food pan 50 from the shelving system 100, the user simply lifts the food pan 50 off of the horizontal supports 14 and pulls the food pan 50 out of the shelving unit 100, or slides or pulls the food pan 50 in the proximal direction toward themselves until the lip or rim of the food pan 50 slides off the edge of each horizontal support 14.

The user may then repeat the process by inserting another food pan 50 between the same two adjacent shelving racks 10 by sliding the second food pan 50 on any pair of free or available horizontal supports 14, thereby creating a substantially stacked configuration of stored food pans 50 and maximizing the storage space of the shelf 154. It should be noted that because the food pans 50 are held in a suspended stacked configuration by the adjacent adjustment shelving racks 10, the food pans 50 do not directly rest on or contact one another. The user may therefore place comestible goods or other items within each of the food pans 50 without having the food pan 50 stacked above it crush or otherwise may be ruin the goods contained within the food pan 50 beneath it. Additionally, because each food pan 50 is stored in a suspended state, the user may add or remove a food pan 50 from the very bottom of the adjacent shelving racks 10 without having to first move or adjust any of the food pans 50 which are disposed directly above it.

While it has been described above that each food pan 50 is inserted longitudinally into the shelving system 100, it should be expressly noted that the food pan 50 may be inserted laterally by altering or changing one or both of the adjacently disposed shelving racks 10 so as to match the overall length of the food pan 50. For example, as discussed above, the relative position of each adjustment shelving rack 10 may be changed by loosening each vice assembly 20 and then sliding the adjustment shelving rack 10 to the new desired position. Each food pan 50 may then be supported in a suspended stacked configuration in the same manner disclosed above, namely be placing each lateral end or edge of the food pan 50 on the corresponding horizontal supports 14.

Figure 7A:
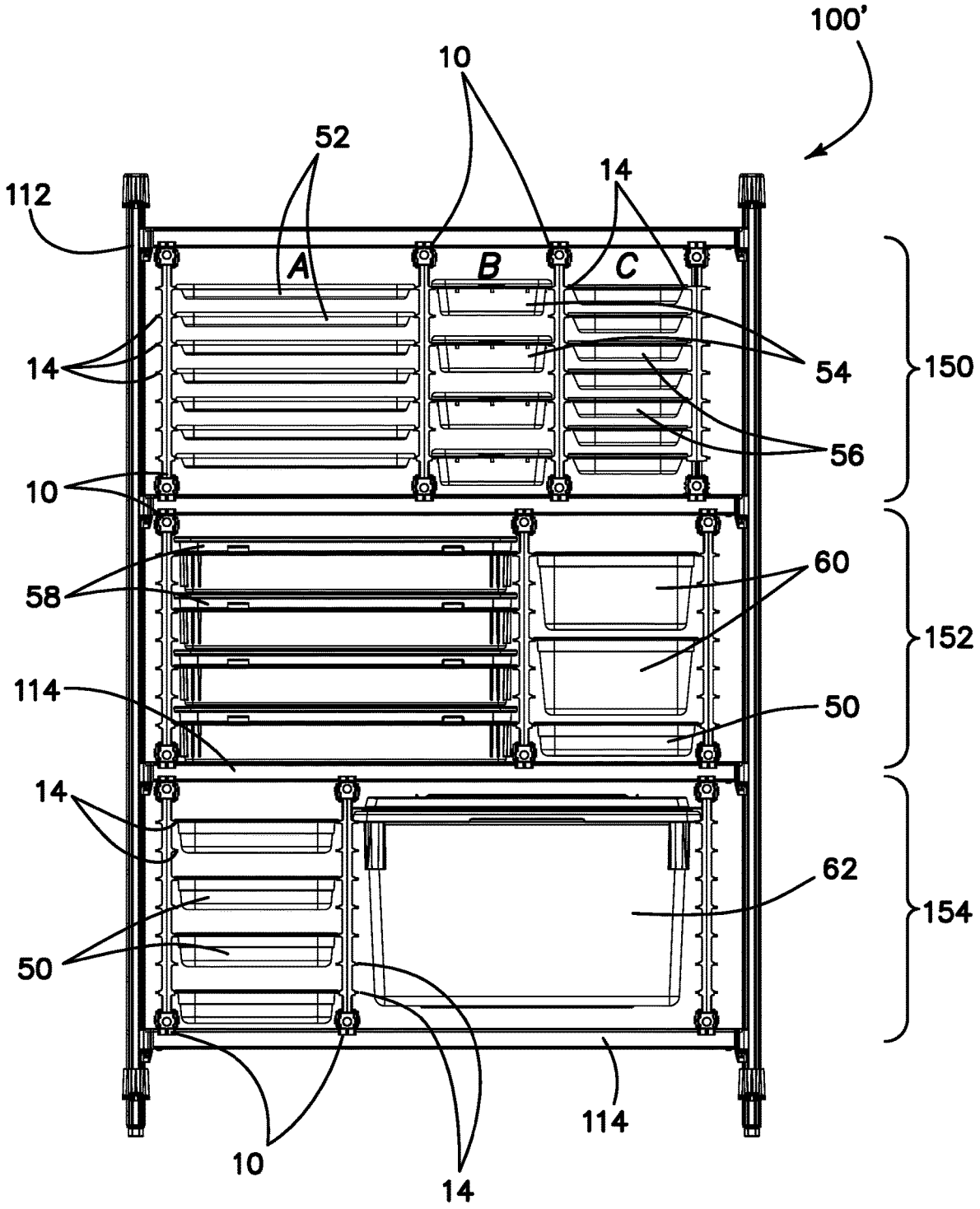
FIG. 7A is a front view an alternative embodiment of the shelving unit comprises a plurality of shelves, each of the shelves comprising a plurality of item containers suspended in a stacked vertical configuration.
Figure 7B:
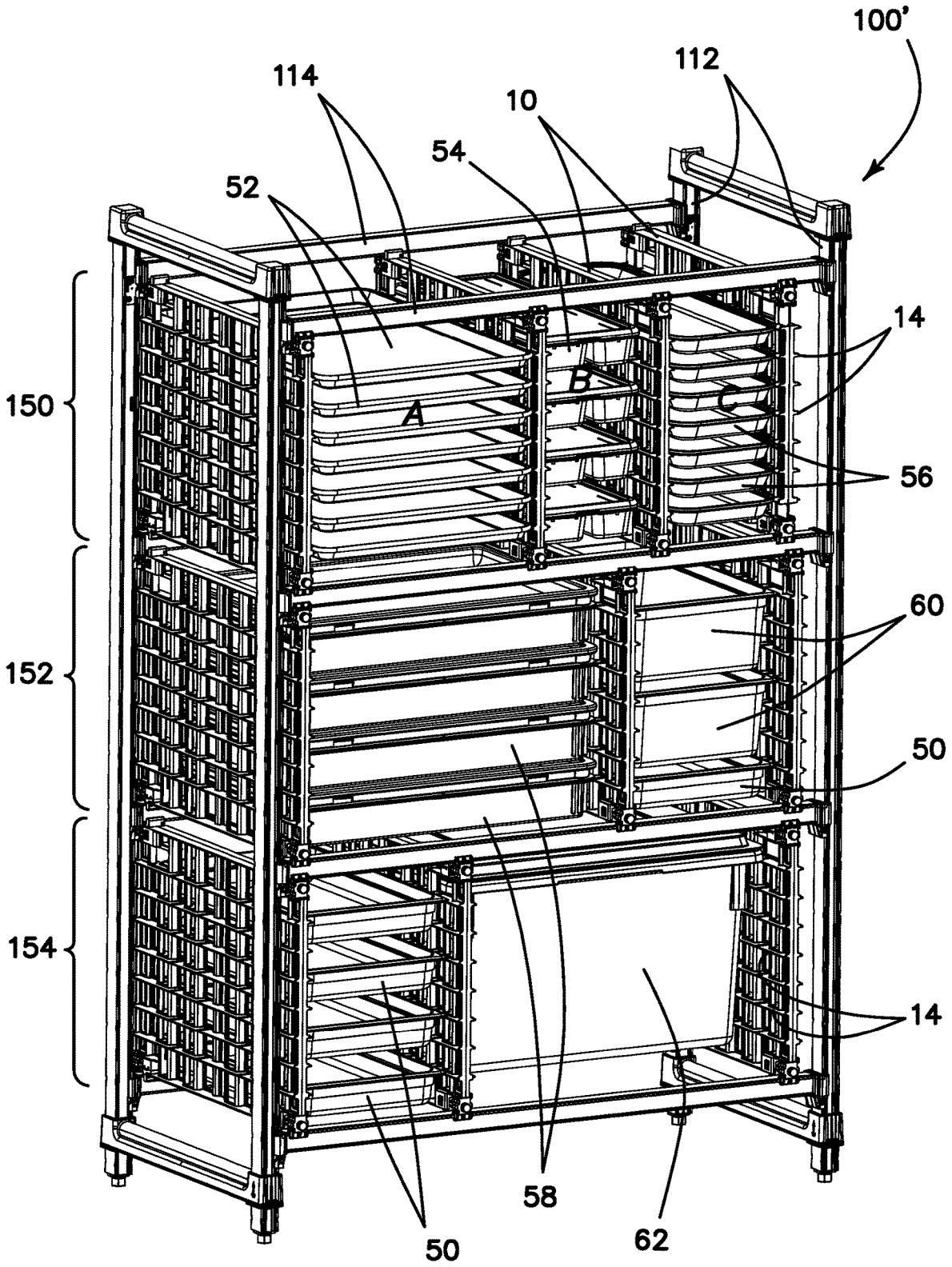
FIG. 7B is a perspective view of the alternative shelving unit seen in FIG. 7A.

Relatedly, as seen in FIGS. 7A and 7B, the plurality of shelving racks 10 can be used to accommodate a plurality of different types of food or item containers that are different sizes or shapes, specifically with one type or size of container disposed within each sub area as defined by the adjustable shelving racks 10. For example, the top most level or shelf 150 of the shelving unit 100 comprises four adjustable shelving racks 10 disposed along the longitudinal lengths of each respective traverse 114 at the appropriate positions which correspond to accommodating three different types of containers, namely a plurality of sheet pans 52 in sub-area A, a plurality of compartment trays 54 in sub-area B, and a plurality of market trays 56 in sub-area C. As is clearly seen in FIGS. 7A and 7B, the sheet pans 52 comprise a different height and width relative to the compartment trays 54 which in turn comprise a different height and width relative to the market trays 56, however no matter the specific dimensions of the containers, each adjustment shelving rack 10 is capable of accommodating multiple different types of containers in a suspended stacked configuration. In a preferred embodiment the horizontal supports 14 of each adjustment shelving rack 10 are spaced two inches apart from each other so that a maximum number of containers may be accommodated, however even containers with a larger relative height such as the plurality of pizza dough boxes 58 disposed on the middle level or shelf 152 or the large food box 62 disposed on the lower level or shelf 154 may be accommodated by the adjustment shelving racks 10 if desired. It should be made explicit that where two different containers comprise at least one dimension which is the same or substantially similar, both containers may be accommodated in a suspended stacked configuration between the same two adjacently disposed adjustable shelving racks 10. For example, a food pan 50 and a plurality of small food boxes 60 may be disposed on the same two adjacent adjustment shelving racks 10 as seen in the middle level or shelf 152 of the shelving unit 100 since both the food pan 50 and the small food box 60 comprise the same overall width, for example.

In a related embodiment, a user may be place a plurality of shelving units 100 side by side to create a shelving system with extended or elongated levels or shelves 150, 152, 154. The user may then dispose a plurality of shelving racks 10 across the horizontal traverses 114 so that a variety of containers could be stored in a suspended stacked configuration in between different adjacent shelving units 100, 100'. For example, a user may couple a shelving rack 10 to the traverses 114 of two adjacent shelving units 100, 100' and then store a plurality of long containers such as the pizza dough boxes 58 between the shelving racks 10. The user may then access the containers from either shelving unit 100, 100', specifically either longitudinal or lateral side of either shelving unit 100, 100'.

The specific number and configuration of shelving racks 10 seen in FIGS. 7A and 7B and discussed above are meant to be for illustrative purposes only. Fewer or additional shelving racks 10 for each shelf 150, 152, 154 or for the overall shelving unit 100, 100' may be used without departing from the original spirit and scope of the invention. Additionally, the user may accommodate different types of items or containers in different orders or configurations other from what is explicitly shown by disposing or coupling each shelving rack 10 to the appropriate position along each traverse 114 as is needed to meet the specific requirements of the user.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A method for suspending a plurality of item containers in a shelving unit comprising:

disposing a plurality of adjustable shelving racks within the shelving unit, the shelving unit comprising a plurality of traverses disposed between a plurality of posts;

adjusting a substantially longitudinal position of at least one of the plurality of adjustable shelving racks relative to at least one of the plurality of traverses;

selectively coupling the plurality of adjustable shelving racks to the plurality of traverses forming the shelving unit;

inserting the plurality of item containers in between at least two of the plurality of adjustable shelving racks; and disposing each of the plurality of item containers on a corresponding substantially horizontal support within each of the at least two of the plurality of adjustable shelving racks, where selectively coupling the plurality of adjustable shelving racks to a plurality of traverses forming the shelving unit comprises:

opening at least one vice assembly disposed on each of the plurality of adjustable shelving racks;

accommodating a width of at least one of the plurality of traverses within the at least vice assembly disposed on each of the plurality of adjustable shelving racks; and closing the vice assembly, wherein closing the vice assembly applies a squeezing force to the at least one of the plurality of traverses by the vice assembly.

2. The method of claim 1 wherein disposing the plurality of adjustable shelving racks within the shelving unit comprises:

disposing a first plurality of vice assemblies disposed on each of the plurality of adjustable shelving racks over a corresponding first parallel pair of the plurality of traverses;

rotating the plurality of adjustable shelving racks relative to the first parallel pair of the plurality of traverses; and simultaneously disposing a second plurality of vice assemblies disposed on each of the plurality of adjustable shelving racks over a corresponding second parallel pair of the plurality of traverses.

3. The method of claim 1 wherein inserting the plurality of item containers in between at least two of the plurality of adjustable shelving racks comprises inserting the plurality of item containers in a stacked vertical configuration between the at least two of the plurality of adjustable shelving racks.

4. The method of claim 1 wherein disposing the plurality of adjustable shelving racks within the shelving unit comprises disposing the plurality of adjustable shelving racks across at least two of the plurality of traverses disposed within the shelving unit.

5. The method of claim 1 wherein disposing each of the plurality of item containers on a corresponding substantially horizontal support within each of the at least two of the plurality of adjustable shelving racks comprises disposing at least two of the plurality of item containers on opposing sides of the same one of the at least two of the plurality of adjustable shelving racks.

6. A method for suspending a plurality of item containers in a shelving unit comprising:

disposing a plurality of adjustable shelving racks within the shelving unit, the shelving unit comprising a plurality of traverses disposed between a plurality of posts;

adjusting a substantially longitudinal position of at least one of the plurality of adjustable shelving racks relative to at least one of the plurality of traverses;

selectively coupling the plurality of adjustable shelving racks to the plurality of traverses forming the shelving unit;

inserting the plurality of item containers in between at least two of the plurality of adjustable shelving racks; and disposing each of the plurality of item containers on a corresponding substantially horizontal support within each of the at least two of the plurality of adjustable shelving racks, where selectively coupling the plurality of adjustable shelving racks to a plurality of traverses forming the shelving unit comprises:

opening a cam lever assembly disposed on each of the plurality of adjustable shelving racks;

accommodating a width of at least one of the plurality of traverses within the cam lever assembly; and actuating the cam lever assembly to close the cam lever assembly onto the at least one of the plurality of traverses, wherein actuating the cam lever assembly applies a squeezing force to the at least one of the plurality of traverses by the cam lever assembly.

7. The method of claim 6 wherein inserting the plurality of item containers in between at least two of the plurality of adjustable shelving racks comprises inserting the plurality of item containers in a stacked vertical configuration between the at least two of the plurality of adjustable shelving racks.

8. The method of claim 6 wherein disposing the plurality of adjustable shelving racks within the shelving unit comprises disposing the plurality of adjustable shelving racks across at least two of the plurality of traverses disposed within the shelving unit.

9. The method of claim 6 wherein disposing each of the plurality of item containers on a corresponding substantially horizontal support within each of the at least two of the plurality of adjustable shelving racks comprises disposing at least two of the plurality of item containers on opposing sides of the same one of the at least two of the plurality of adjustable shelving racks.

* * * * *